US011355258B2

(12) United States Patent
Sumi et al.

(10) Patent No.: US 11,355,258 B2
(45) **Date of Patent: *Jun. 7, 2022**

(54) ALUMINUM ALLOY WIRE ROD AND PRODUCING METHOD THEREFOR

(71) Applicant: Hitachi Metals, Ltd., Tokyo (JP)

(72) Inventors: Toru Sumi, Tokyo (JP); Kazuya Nishi, Tokyo (JP); Shohei Hata, Tokyo (JP); Takashi Hayasaka, Tokyo (JP); Takeshi Usami, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 285 days.

This patent is subject to a terminal disclaimer.

(21) Appl. No.: 16/681,534

(22) Filed: Nov. 12, 2019

(65) Prior Publication Data

US 2021/0005342 A1 Jan. 7, 2021

(30) Foreign Application Priority Data

Jul. 4, 2019 (JP) ..... JP2019-125154
Jul. 4, 2019 (JP) ..... JP2019-125155

(51) Int. Cl.
*H01B 1/02* (2006.01)
*C22F 1/04* (2006.01)
(Continued)

(52) U.S. Cl.
CPC ..... *H01B 1/023* (2013.01); *C22C 21/00* (2013.01); *C22F 1/002* (2013.01); *C22F 1/04* (2013.01)

(58) Field of Classification Search
CPC . C22F 1/04; C22F 1/002; C22C 21/00; H01B 1/023
See application file for complete search history.

(56) References Cited

U.S. PATENT DOCUMENTS 9,564,254 B2 2/2017 Kobayashi
10,192,649 B2 1/2019 Nishi et al.
(Continued)

FOREIGN PATENT DOCUMENTS

JP 2012-229485 A 11/2012

OTHER PUBLICATIONS

United States Office Action dated Aug. 13, 2020 in U.S. Appl. No. 16/191,622.

(Continued)

*Primary Examiner* — Anthony M Liang
*Assistant Examiner* — Danny N Kang
(74) *Attorney, Agent, or Firm* — McGinn IP Law Group, PLLC

(57) ABSTRACT

A wire rod made of an aluminum alloy. The aluminum alloy includes Al crystal grains, an Al—Zr compound, and an Al—Co—Fe or Al—Ni—Fe compound. The aluminum alloy includes high-angle tilt crystal grain boundaries, each of which has a difference between crystal orientations in both its sides of 15 degrees or more, and low-angle tilt crystal grain boundaries, each of which has a difference between crystal orientations in both its sides of 2 degrees or more and less than 15 degrees. An average grain diameter of ones of the Al crystal grains surrounded by the high-angle boundaries is 12 μm or more. An average grain diameter of the ones of the Al crystal grains surrounded by the high-angle boundaries, ones of the Al crystal grains surrounded by the high-angle boundaries and the low-angle boundaries, and ones of the Al crystal grains surrounded by the low-angle boundaries, is 10 μm or less.

16 Claims, 5 Drawing Sheets

(51) Int. Cl.
*C22F 1/00* (2006.01)
*C22C 21/00* (2006.01)

(56) References Cited

U.S. PATENT DOCUMENTS

| | | | |
|---|---|---|---|
| 2013/0264115 | A1 | 10/2013 | Kobayashi et al. |
| 2017/0098487 | A1 | 4/2017 | Kobayashi et al. |
| 2017/0213619 | A1 | 7/2017 | Sekiya et al. |
| 2019/0345594 | A1 | 11/2019 | Sumi et al. |

OTHER PUBLICATIONS

Japanese Office Action, dated Mar. 22, 2022, in Japanese Application No. 2019-125155 and English Translation thereof.

ALUMINUM ALLOY WIRE ROD AND PRODUCING METHOD THEREFOR

CROSS-REFERENCE TO RELATED APPLICATIONS

The present invention is based on Japanese Patent Application No. 2019-125154 filed on Jul. 4, 2019 and Japanese Patent Application No. 2019-125155 filed on Jul. 4, 2019, the entire contents of which are incorporated herein by reference.

BACKGROUND OF THE INVENTION

1. Field of the Invention

The present invention relates to an aluminum alloy wire rod and a producing method therefor.

2. Description of the Related Art

In applications to train vehicles, automobiles, wind power generation, and other electric devices or the like, electric wires or cables having a conductor made of a copper or a copper alloy are used as wiring members. There is a great demand for a weight reduction for these electric wires or cables from the viewpoint of reducing energy consumption in automobiles or the like. To this end, in recent years, using a conductor configured with a wire rod made of an aluminum or an aluminum alloy smaller in specific gravity than the copper or the copper alloy in the electric wires or cables to be used in these applications is being considered.

For example, JP-A-2012-229485 proposes such a method as to add an alloy element such as magnesium (Mg), zirconium (Zr) or the like to an aluminum alloy, and aging precipitate these elements. JP-A-2012-229485 discloses employing a wire rod (an aluminum alloy wire rod) made of such an aluminum alloy as a conductor, to thereby be able to enhance the strength, elongation, electrical conductivity, and heat resistance of that conductor. Note that the heat resistance in JP-A-2012-229485 refers to the strength of that conductor being 150 MPa or more when that conductor is held at a temperature from room temperature to 150 degrees C. for 1000 hours.

[Patent Document 1] JP-A-2012-229485

SUMMARY OF THE INVENTION

Now, in the electric wires or cables, when the aluminum alloy wire rod is used as the conductor, an attempt to achieve the same properties as when the copper is used as the conductor leads to an increase in the cross-sectional area of the conductor as compared to when the copper is used. In particular, in a moving vehicle such as a train vehicle or the like, a wiring space to wire the electric wires or cables is limited. For that reason, it is desired that the cross-sectional area of the conductor configured with the aluminum alloy wire rod is made as small as possible to wire the electric wires or cables in the same wiring space as when the copper is used as the conductor.

That is, in the electric wires or cables with the conductor configured with the aluminum alloy wire rod therein, it is desired that the aluminum alloy wire rod is used that is able to have its strength, elongation, electrical conductivity, and heat resistance at a high level and in a well-balanced manner, when the cross-sectional area of the conductor configured with the aluminum alloy wire rod is made as small as the cross-sectional area of the conductor configured with the copper.

An object of the present invention is to provide an aluminum alloy wire rod, which has a strength, an elongation, an electrical conductivity, and a heat resistance at a high level and in a well-balanced manner.

One aspect of the present invention provides an aluminum alloy wire rod, comprising:

a wire rod made of an aluminum alloy, the aluminum alloy having a chemical composition consisting of:

Co or Ni: 0.1 to 1.0% by mass; Zr: 0.2 to 1.0% by mass; Fe: 0.02 to 0.15% by mass; Si: 0.02 to 0.15% by mass; Mg: 0 to 0.2% by mass; Ti: 0 to 0.10% by mass; B: 0 to 0.03% by mass; Cu: 0 to 1.00% by mass; Ag: 0 to 0.50% by mass; Au: 0 to 0.50% by mass; Mn: 0 to 1.00% by mass; Cr: 0 to 1.00% by mass; Hf: 0 to 0.50% by mass; V: 0 to 0.50% by mass; Sc: 0 to 0.50% by mass; and the balance: Al and inevitable impurities, the aluminum alloy having a metallographic structure including:

Al crystal grains; an Al—Zr compound; and an Al—Co—Fe compound when containing the Co, or an Al—Ni—Fe compound when containing the Ni, wherein, when a crystal orientation analysis of a cross section parallel to a longitudinal direction of the wire rod is performed by electron beam backscatter diffraction, the metallographic structure includes high-angle tilt crystal grain boundaries, each of which has a difference between crystal orientations in both its sides of 15 degrees or more, and low-angle tilt crystal grain boundaries, each of which has a difference between crystal orientations in both its sides of 2 degrees or more and less than 15 degrees, wherein an average grain diameter of ones of the Al crystal grains, which are surrounded by the high-angle tilt crystal grain boundaries, is 12 μm or more, while an average grain diameter of the ones of the Al crystal grains, which are surrounded by the high-angle tilt crystal grain boundaries, ones of the Al crystal grains, which are surrounded by the high-angle tilt crystal grain boundaries and the low-angle tilt crystal grain boundaries, and ones of the Al crystal grains, which are surrounded by the low-angle tilt crystal grain boundaries, is 10 μm or less.

Another aspect of the present invention provides a method for producing a wire rod made of an aluminum alloy, comprising:

preparing a molten metal having a chemical composition consisting of Co or Ni: 0.1 to 1.0% by mass, Zr: 0.2 to 1.0% by mass, Fe: 0.02 to 0.15% by mass, Si: 0.02 to 0.15% by mass, Mg: 0 to 0.2% by mass, Ti: 0 to 0.10% by mass, B: 0 to 0.03% by mass, Cu: 0 to 1.00% by mass, Ag: 0 to 0.50% by mass, Au: 0 to 0.50% by mass, Mn: 0 to 1.00% by mass, Cr: 0 to 1.00% by mass, Hf: 0 to 0.50% by mass, V: 0 to 0.50% by mass, Sc: 0 to 0.50% by mass, and the balance: Al and inevitable impurities;

casting the molten metal to form a cast rod;

subjecting the cast rod to a wire drawing to form a drawn wire rod; and subjecting the drawn wire rod to an aging treatment, wherein the casting is performed in such a manner as to adjust a temperature of the molten metal at not lower than 850 degrees C., pour the molten metal into a mold, and in that mold, cast the molten metal by rapid cooling at such a cooling rate as to allow the Co to crystallize out while suppressing the Zr from crystallizing out, to thereby form the cast rod including the Al—Co—Fe compound when containing the Co, or the Al—Ni—Fe compound when containing the Ni, wherein the aging treatment is performed in such a manner as to precipitate the Zr forming a solid solution in an Al phase of the drawn wire rod as an Al—Zr compound, wherein the aluminum alloy has a metallographic structure including the aforesaid chemical composition, Al crystal grains, the Al—Zr compound, and the Al—Co—Fe compound or the Al—Ni—Fe compound, wherein, when a crystal orientation analysis of a cross section parallel to a longitudinal direction of the wire rod is performed by electron beam backscatter diffraction, the metallographic structure includes high-angle tilt crystal grain boundaries, each of which has a difference between crystal orientations in both its sides of 15 degrees or more, and low-angle tilt crystal grain boundaries, each of which has a difference between crystal orientations in both its sides of 2 degrees or more and less than 15 degrees, wherein an average grain diameter of ones of the Al crystal grains, which are surrounded by the high-angle tilt crystal grain boundaries, is 12 μm or more, while an average grain diameter of the ones of the Al crystal grains, which are surrounded by the high-angle tilt crystal grain boundaries, ones of the Al crystal grains, which are surrounded by the high-angle tilt crystal grain boundaries and the low-angle tilt crystal grain boundaries, and ones of the Al crystal grains, which are surrounded by the low-angle tilt crystal grain boundaries, is 10 μm or less.

Yet another aspect of the present invention provides an aluminum alloy wire rod, comprising:

a wire rod made of an aluminum alloy, the aluminum alloy having a chemical composition consisting of:

Co or Ni: 0.1 to 1.0% by mass; Zr: 0.2 to 1.0% by mass; Fe: 0.02 to 0.15% by mass; Si: 0.02 to 0.15% by mass; Mg: 0 to 0.2% by mass; Ti: 0 to 0.10% by mass; B: 0 to 0.03% by mass; Cu: 0 to 1.00% by mass; Ag: 0 to 0.50% by mass; Au: 0 to 0.50% by mass; Mn: 0 to 1.00% by mass; Cr: 0 to 1.00% by mass; Hf: 0 to 0.50% by mass; V: 0 to 0.50% by mass; Sc: 0 to 0.50% by mass; and the balance: Al and inevitable impurities, the aluminum alloy having a metallographic structure including:

Al crystal grains; an Al—Zr compound; and an Al—Co—Fe compound when containing the Co, or an Al—Ni—Fe compound when containing the Ni, the aluminum alloy comprising:

a tensile strength of 180 MPa or higher;

an electrical conductivity of 53% IACS or higher; and an elongation of 10% or higher, whereby the aluminum alloy satisfies a condition for an Arrhenius plot, which is obtained from a temperature used and a time taken for the tensile strength of the wire rod to become 10% lower than its initial tensile strength, yielding 10 years or longer at a temperature of 200 degrees C.

Points of the Invention

According to the present invention, it is possible to provide the aluminum alloy wire rod, which has a strength, an elongation, an electrical conductivity, and a heat resistance at a high level and in a well-balanced manner.

DETAILED DESCRIPTION OF THE PREFERRED EMBODIMENTS

Figure 1:
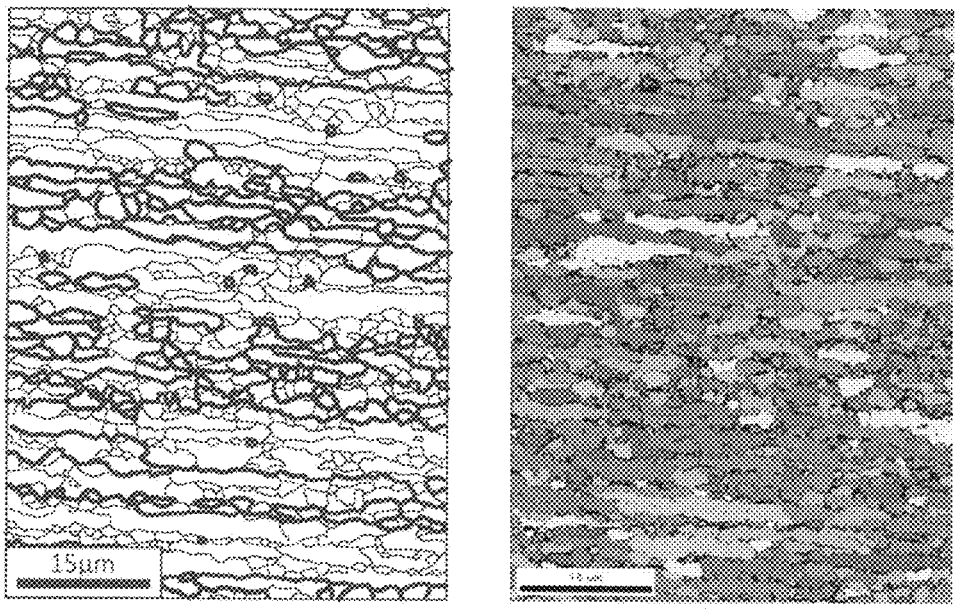
FIG. 1 is a diagram showing a crystal grain shape map obtained when an EBSD measurement is performed on a cross section parallel to a longitudinal direction for an alloy wire rod of Example 2.

In order to solve the above-mentioned problems, the present inventors have examined changes in various properties when changing a chemical composition of an aluminum alloy by appropriately altering kinds of alloy elements, producing conditions or the like. As a result, it has been found out that Co or Ni and Zr may be used as the alloy elements. In addition, in producing an aluminum alloy wire rod containing these elements, it has been found out that a molten metal may be cooled rapidly, after setting the temperature of the molten metal at an elevated temperature so that the solid solution limit of each element might become high. By rapidly cooling the molten metal from an elevated temperature in this way, it has been found out that, in the resulting cast rod, more of each element can remain in a solid solution state, and therefore that the final produced wire rod has its strength, elongation, electrical conductivity, and heat resistance at a high level and in a well-balanced manner. The present invention has been made based on those findings.

One Embodiment

Hereinafter, one embodiment of the present invention will be described. Note that herein, numerical value ranges represented by using "to" mean the ranges including numerical values mentioned before and after "to" as a lower limit value and an upper limit value, respectively.

<Aluminum Alloy Wire Rod>

Hereinafter, for an aluminum alloy wire rod according to one embodiment of the present invention, a case where Co and Zr are used as the alloy elements will be described as an example.

(Chemical Composition)

First, a chemical composition of an aluminum alloy (hereinafter also simply referred to as the alloy) constituting the aluminum alloy wire rod (hereinafter also simply referred to as the alloy wire rod) will be described.

The chemical composition of the alloy consists of: Co: 0.1 to 1.0% by mass; Zr: 0.2 to 1.0% by mass; Fe: 0.02 to 0.15% by mass; Si: 0.02 to 0.15% by mass; Mg: 0 to 0.2% by mass; Ti: 0 to 0.10% by mass; B: 0 to 0.03% by mass; Cu: 0 to 1.00% by mass; Ag: 0 to 0.50% by mass; Au: 0 to 0.50% by mass; Mn: 0 to 1.00% by mass; Cr: 0 to 1.00% by mass; Hf: 0 to 0.50% by mass; V: 0 to 0.50% by mass; Sc: 0 to 0.50% by mass; and the balance: Al and inevitable impurities.

In the alloy wire rod producing process (in the process of casting), most of the Co reacts with the Al to form a crystallized product (an Al—Co compound), so the Co is present in the final produced alloy wire rod in the form of the compound phase, as will be described later. The Al—Co compound is actually present in the form of an Al—Co—Fe compound with the Fe absorbed therein, which is unavoidably present in the aluminum alloy. The Al—Co—Fe compound contributes to the fine graining of Al recrystallized grains in the alloy and allows an enhancement in the elongation of the alloy wire rod. Although the Co may lower the electrical conductivity of the alloy, by setting the Co content at 0.1% by mass to 1.0% by mass, it is possible to allow the Co to produce the effect of having the strength, the elongation, and the heat resistance at a high level and in a well-balanced manner while suppressing the lowering of the electrical conductivity due to the Co in the alloy wire rod. The Co content is preferably 0.2% by mass to 1.0% by mass, and more preferably 0.3% by mass to 0.8% by mass.

Although the Zr is present mainly in a solid solution state in a cast ingot (cast rod), the Zr precipitates as an Al—Zr compound in the alloy wire rod after aging heat treatment, as will be described later. The Al—Zr compound contributes primarily to an enhancement in the heat resistance of the alloy wire rod. If the Zr content is excessively high, the ductility of the alloy is lowered in the process of producing the alloy wire rod, which may lead to failure to make the alloy wire rod thin in diameter. In this regard, by setting the Zr content at 0.2% by mass to 1.0% by mass, it is possible to maintain the high ductility of the alloy and achieve the desired heat resistance in the alloy wire rod. The Zr content is more preferably 0.3% by mass to 0.9% by mass. In the present embodiment, by increasing the temperature of the molten metal and rapidly cooling it in the mold, even when the Zr content is increased, it is possible to allow the Zr to remain in a solid solution state during casting, and it is therefore possible to achieve the balance of the various properties at a higher level in the final produced alloy wire rod, as will be described later.

The Fe is a component that is inevitably introduced by derivation from an aluminum raw material. The Fe contributes to an enhancement in the strength of the alloy. When the Fe crystallizes out as $FeAl_3$ during casting, or when the Fe precipitates as $FeAl_3$ during aging heat treatment, the ductility of the alloy is lowered, which may lead to failure to make the alloy wire rod thin in diameter during production. In the present embodiment, by compounding the Co, when the Al—Co compound is crystallized (i.e. crystallized out), the Fe is absorbed therein, thereby resulting in the Al—Co—Fe compound. This results in the Fe as the Al—Co—Fe compound, thereby suppressing the formation of $FeAl_3$. As a result, it is possible to enhance the strength of the alloy while suppressing the lowering of the ductility of the alloy. The Fe content may be set at not higher than the Co content from the viewpoint of absorbing the Fe into the Al—Co compound, and the Fe content is set at 0.02% by mass to 0.15% by mass. This makes it possible to achieve the high strength, while making the alloy wire rod thin in diameter. The Fe content is preferably 0.04% by mass to 0.15% by mass. Note that the Fe may be added so as to achieve the predetermined content.

The Si, as with the Fe, is a component that is inevitably introduced by derivation from the aluminum raw material. The Si contributes to an enhancement in the strength of the alloy by forming a solid solution in Al crystal grains of the alloy or by precipitating together with the Fe. Although the Si may, as with the Fe, lead to a lowering in the elongation of the alloy or failure to make the alloy wire rod thin in diameter, by setting the Si content at 0.02% by mass to 0.15% by mass, it is possible to enhance the strength of the alloy while suppressing the lowering of the elongation of the alloy. The Si content is preferably 0.04% by mass to 0.12% by mass. Note that the Si may be added so as to achieve the predetermined content.

The Mg, Ti, B, Cu, Ag, Au, Mn, Cr, Hf, V, and Sc are optional components that are introduced by derivation from the aluminum raw material or appropriately added according to needs. Here, the optional components refer to the components that may or may not be contained. Each alloy element suppresses the coarsening of the crystal grains in the Al phase in the alloy wire rod, and contributes to an enhancement in the strength of the alloy wire rod. Of these, the Cu, Ag, and Au are able to precipitate at crystal grain boundaries and enhance the grain boundary strength as well. By setting each alloy element content within their respective above described ranges, it is possible to achieve the effects of each alloy element while suppressing the lowering of the elongation of the alloy.

The remaining portion other than the above described components is the Al and the inevitable impurities. Here, the inevitable impurities refer to ones that are inevitably introduced by derivation in the process of producing the alloy wire rod, and that are low in content without affecting the properties of the alloy wire rod. As the inevitable impurities, for example Ga, Zn, Bi, and Pb can be mentioned.

From the viewpoint of the electrical conductivity of the alloy wire rod, the Al content is preferably not lower than 97% by mass, more preferably not lower than 98% by mass, and still more preferably not lower than 98.4% by mass.

(Metallographic Structure)

Next, a metallographic structure of the aluminum alloy will be described.

The aluminum alloy wire rod of the present embodiment has a metallographic structure including the Al crystal grains, the Al—Co—Fe compound, and the Al—Zr compound. In the metallographic structure, the Al—Co—Fe compound and the Al—Zr compound are dispersed and present at the crystal grain boundaries.

The metallographic structure of the alloy wire rod is preferably configured in the following manner from the viewpoint of achieving the strength, the elongation, the electrical conductivity, and the heat resistance of the alloy wire rod at a high level and in a well-balanced manner.

Specifically, when a crystal orientation analysis is performed on a cross section parallel to a longitudinal direction of the alloy wire rod by electron beam backscatter diffraction (hereinafter also referred to as the EBSD), high-angle tilt crystal grain boundaries and low-angle tilt crystal grain boundaries are present in the metallographic structure of that cross section. The high-angle tilt crystal grain boundary refers to a grain boundary which has a difference between crystal orientations in both its sides of 15 degrees or more, while the low-angle tilt crystal grain boundary refers to a grain boundary which has a difference between crystal orientations in both its sides of 2 degrees or more and less than 15 degrees. Ones of the Al crystal grains (hereinafter also referred to as the first Al crystal grains), which are surrounded by the high-angle tilt crystal grain boundaries, are coarse crystal grains, while ones of the Al crystal grains (hereinafter, also referred to as the second Al crystal grains), which are surrounded by the small-angle tilt crystal grain boundaries, are fine crystal grains.

As will be described later, in the present embodiment, in an aging treatment step, a processing strain in the drawn wire rod can be mitigated by a crystal recovery while the recrystallization of the Al crystal grains is being suppressed from occurring. The crystal recovery allows a plurality of the small-angle tilt crystal grain boundaries to be formed within the first Al crystal grains surrounded by the high-angle tilt crystal grain boundaries, and the first Al crystal grains to be configured in such a manner as to be divided by the plurality of small-angle tilt crystal grain boundaries. That is, the first Al crystal grains can be configured in such a manner as to enclose the plurality of the fine second Al crystal grains therein. Further, the suppression of the recrystallization of the Al crystal grains allows making small the number of fine first Al crystal grains (hereinafter also referred to as the recrystallized grains) that are newly created as the result of the recrystallization and surrounded by the high-angle tilt crystal grain boundaries.

Further, in the metallographic structure of the alloy wire rod, since the proportion of the recrystallized grains in the first Al crystal grains is low, the average grain diameter of the first Al crystal grains is large. The average grain diameter of the first Al crystal grains is not particularly limited, but is preferably 12 μm or more. Also, the average grain diameter of the Al crystal grains, which are surrounded by the grain boundaries where the crystal orientation difference is 2 degrees or more, in other words, the average grain diameter of ones of the Al crystal grains, which are surrounded by the high-angle tilt crystal grain boundaries, ones of the Al crystal grains, which are surrounded by the high-angle tilt crystal grain boundaries and the low-angle tilt crystal grain boundaries, and ones of the Al crystal grains, which are surrounded by the low-angle tilt crystal grain boundaries, is not particularly limited, but is preferably 10 μm or less, and more preferably 0.5 μm or more and 10 μm or less.

Note that herein, the crystal grain diameters of the Al crystal grains refer to the diameters when the Al crystal grains are assumed to be circular, as will be described in Examples described later. Specifically, the areas of the Al crystal grains are calculated, and the diameters of circles having the same areas as those areas are the crystal grain diameters of the Al crystal grains. For example, the crystal grain diameter of the first Al crystal grain refers to the diameter of a circle having the same area as that of a region surrounded by the high-angle tilt crystal grain boundaries in the cross section parallel to the longitudinal direction of the aluminum alloy wire rod. The crystal grain diameter of the second Al crystal grain refers to the diameter of a circle having the same area as that of a region surrounded by both the low-angle tilt crystal grain boundaries and the high-angle tilt crystal grain boundaries.

The Al—Co—Fe compound is a crystallized phase, which is formed at the stage of solidifying the molten metal by cooling when casting the aluminum alloy, or at the stage of cooling the high temperature cast rod to near room temperature even after solidification. That is, the Al—Co—Fe compound is a crystallized product, which is formed in the aluminum alloy at the stage of the cast rod. The Al—Zr compound is a precipitated phase, which is formed in the stage of aging treatment, which heats and holds the cast rod cooled to room temperature in a high temperature atmosphere below a melting point. Specifically, the Al—Zr compound is a precipitated product, which is formed for the first time by aging treatment allowing the metal element forming a solid solution in the Al phase of the cast rod to diffuse and aggregate in the Al phase. That is, the precipitated product is not present in the Al alloy at the stage of the cast rod, but is present at the stage of the alloy wire rod subjected to the aging treatment.

The size of the Al—Zr compound is distributed in a range of 1 nm or more and several hundreds nm or less, but it is preferable that the proportion of the fine precipitates having the size of 1 nm or more and 100 nm or less is higher than the proportion of the precipitates that are not included in the size range of 1 nm or more and 100 nm or less. By reducing the sizes of the precipitates made of the Al—Zr compound to 1 nm or more and 100 nm or less, even when lowering the alloy element content, it is possible to increase the number of the precipitates, and it is therefore possible to produce the effects of the precipitates in a well-balanced manner. In addition, since the ductility of the alloy can be maintained high, it is possible to increase the degree of processing in a wire drawing step, and it is therefore possible to make the alloy wire rod thinner in diameter.

The size of the Al—Co—Fe compound is preferably 20 nm or more and 1 μm (1000 nm) or less. The Al—Co—Fe compound can be increased in size, for example, by ensuring a sufficient aging time. If the Al—Co—Fe compound is excessively reduced in size, the ductility of the alloy wire rod may be lowered. In this respect, by increasing the size of the Al—Co—Fe compound to 20 nm or more, the ductility of the alloy wire rod can be made high. On the other hand, if the Al—Co—Fe compound is excessively increased in size, the strength of the alloy wire rod may be lowered by later described deformation band formation occurring and recrystallized grains creating. From the viewpoint of achieving the strength of the alloy wire rod, the size of the Al—Co—Fe compound is preferably 1 μm or less. Note that since the Co atoms diffuse in the Al structure at a rate higher than the Zr atoms, the size of the Al—Co—Fe compound becomes larger than that of the Al—Zr compound. As will be described later, a role of the Al—Co—Fe compound is to suppress the growth of the recrystallized grains in the initial stage of the aging heat treatment. For this reason, the Al—Co—Fe compound may become larger than the Al—Zr compound in the metallographic structure after the aging heat treatment is completed.

Further, the shape of the Al—Co—Fe compound is not particularly limited, but the Al—Co—Fe compound is preferably spherical or spheroidal. The Al—Zr compound is preferably spherical, but may be shapeless. Note that the spheroidal shape shows a circular shape in a direction perpendicular to the longitudinal direction of the wire rod, and shows an elliptical shape in a direction parallel to the longitudinal direction of the wire rod.

(Properties of the Aluminum Alloy Wire Rod)

The aluminum alloy wire rod of the present embodiment is formed from the aluminum alloy having the above-described chemical composition and the above-described metallographic structure, and has the strength, the elongation, the electrical conductivity and the heat resistance at a high level and in a well-balanced manner. Specifically, the alloy wire rod has a tensile strength at room temperature of 180 MPa or higher and an elongation of 10% or higher. Further, the alloy wire rod has an electrical conductivity of 53% IACS or higher. Furthermore, the alloy wire rod has a heat resistance such that its strength when heated at 200 degrees C. for 10 years becomes 90% or higher of its strength in an initial state. Note that the "heat resistance such that its strength when heated at 200 degrees C. for 10 years becomes 90% or higher of its strength in an initial state" referred to herein means that the alloy wire rod satisfies a condition for an Arrhenius plot (the logarithm of the Arrhenius equation) yielding 10 years or longer at a temperature of 200 degrees C., where the Arrhenius plot (the logarithm of the Arrhenius equation) is obtained by determining, based on an isothermal softening curve of the tensile strength, which is obtained by heating the aluminum alloy wire rod at a specific temperature and for a specific time, and using a temperature (for example, any temperature in a range of 20 degrees C. to 400 degrees C.) used and a time (for example, any time in a range of 600 sec to 3000000 sec) taken for the tensile strength of the aluminum alloy wire rod to become 10% lower than its tensile strength before heating (its initial tensile strength). In other words, the alloy wire rod satisfies a condition for an Arrhenius plot, which is obtained using a temperature used and a time taken for the tensile strength of the wire rod to become 10% lower than its initial tensile strength, which are determined based on an isothermal softening curve of the tensile strength of the wire rod, yielding 10 years or longer at a temperature of 200 degrees C. Note that this heat resistance evaluation method will be described later in Examples. Also, the tensile strength and the elongation are measured by a testing method (test speed: 20 mm/min) in compliance with JIS Z2241.

The wire diameter of the alloy wire rod is not particularly limited, but is preferably 2 mm or less, more preferably 0.3 mm to 1 mm from the viewpoint of its flexibility. In the present embodiment, by allowing the alloy to have the predetermined configuration, it is possible to achieve the various properties at a high level and in a well-balanced manner while the wire diameter is 2 mm or less.

<Method for Producing the Aluminum Alloy Wire Rod>

Figure 5:
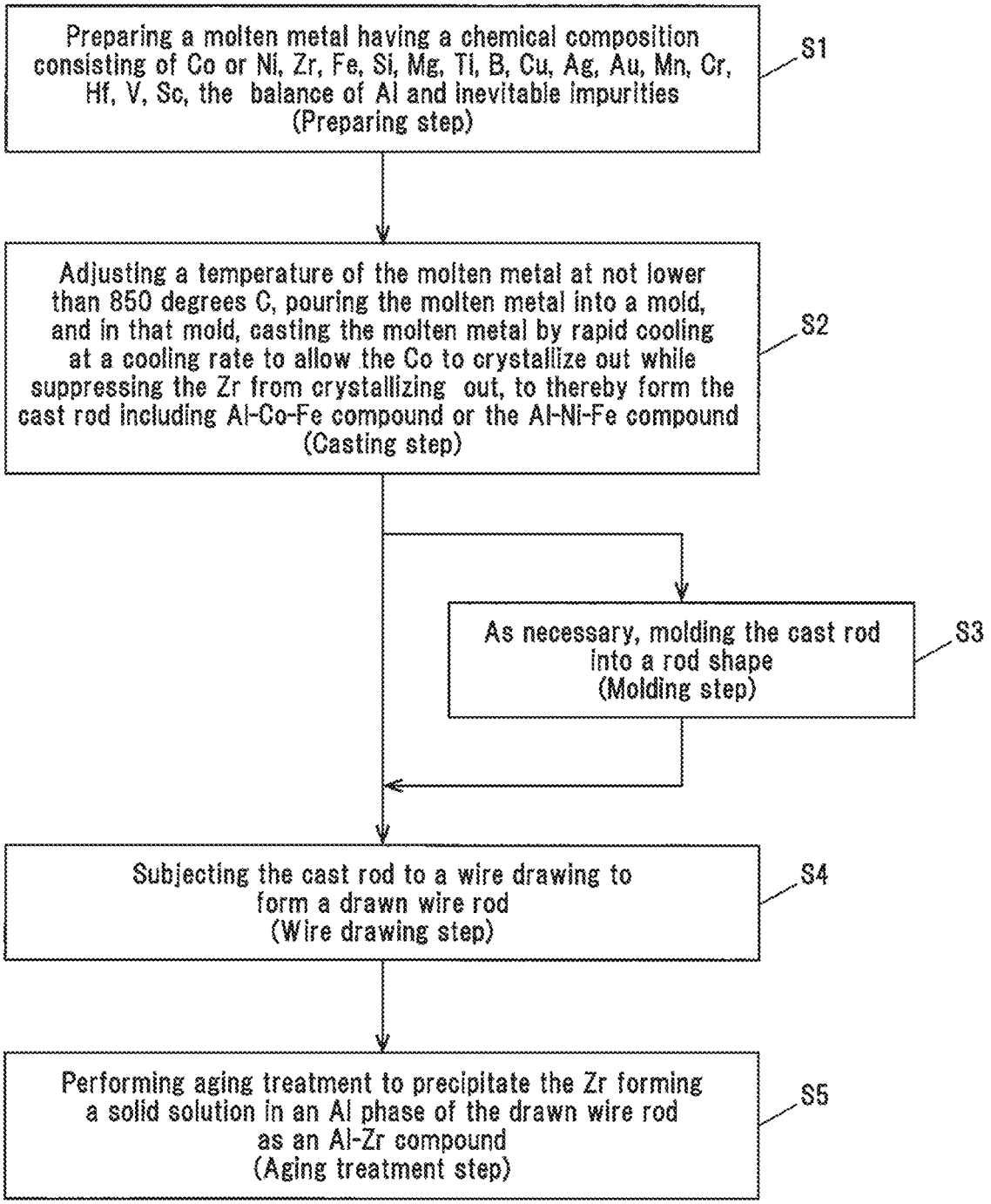

Next, a method for producing the above described aluminum alloy wire rod is described. FIG. 5 is a flowchart showing respective steps of a method for producing an aluminum alloy wire rod in an embodiment according to the present invention. The aluminum alloy wire rod of the present embodiment can be produced by sequentially performing each step of the molten metal preparing step, casting step, forming step, wire drawing step, and aging treatment step. Hereinafter, each step thereof is described in full detail.

(Preparing Step)

First, a molten metal to form the aluminum alloy wire rod is prepared (S1). In the present embodiment, an Al raw material, a Co raw material, and a Zr raw material, and, if desired, other alloy raw materials are mixed so that the molten metal has the above-described chemical composition. Then, these raw materials are put into, for example, a melting furnace and melted by heating with a burner or the like. The method for mixing and melting the raw materials is not particularly limited, but can be performed by a conventionally known method.

The produced molten metal is transferred to a holding bath (so-called tundish) and held therein. The holding bath is provided with a molten metal pouring nozzle so that the molten metal can be drained out from the holding bath.

(Casting Step)

Subsequently, the molten metal is drained out from the holding bath through the molten metal pouring nozzle and poured into a mold (S2). As the mold, for example, a continuous casting machine capable of belt wheel type continuous casting can be used. The continuous casting machine is being configured in such a manner as to include, for example, a circular cylindrical wheel provided with a groove on its outer peripheral surface and a belt, and hang this belt on a part of the outer peripheral surface of the wheel. This continuous casting machine allows the cast rod to be continuously formed by pouring the molten metal into the space (groove portion) formed between the wheel and the belt and solidifying by cooling.

In the present embodiment, the cast rod is formed by setting the temperature of the molten metal as high as not lower than 850 degrees C., and rapidly cooling the molten metal in the mold to thereby allow the Co to crystallize out while suppressing the Zr from crystallizing out. Hereinafter, this point will be described in detail.

First, rapidly cooling the molten metal to thereby allow the Co to crystallize out while suppressing the Zr from crystallizing out (allowing the Zr to remain in the form of a solid solution) is based on the following findings of the present inventors.

According to the study by the present inventors, if the Zr forms a crystallized product with the Fe in the cast rod, the ductility of the cast rod lowers, which may lead to difficulty in drawing the cast rod into a wire. On the other hand, even when the Co forms a crystallized product with the Fe, the ductility of the cast rod is substantially unaffected thereby. From this point of view, in the cast rod, it is desirable to allow the Zr to remain in the form of a solid solution without crystallizing out the Zr, but, on the other hand, to allow the Co to crystallize out. It should be noted, however, that, when the molten metal is cooled, the Zr as well as the Co crystallizes out, therefore leading to difficulty in selectively allowing only the Zr to form a solid solution.

In this regard, the present inventors have focused on the fact that when the molten metal is cooled, the Co has a higher tendency to crystallize out (precipitate) than the Zr, that is, the Co is higher in crystallizing out rate (precipitating rate) than the Zr. This difference in the crystallizing out rate between the Co and the Zr results from the Co and the Zr differing in diffusion rate in the aluminum solid phase.

Specifically, the diffusion rate of the Co in the Al solid phase is equal to or higher than the self-diffusion rate of the Al. Moreover, the solid solubility of the Co in the Al phase in a thermal equilibrium state is very small, smaller than 0.05% at the most. For that reason, the Co, even immediately after being cast and solidified from the molten metal, has a high tendency to easily aggregate and crystallize out in the Al structure. Allowing the Co to crystallize out results in most of the Co crystallizing out in the form of the compound in the Al structure at the stage of the cast ingot (cast rod). Note that, in the Al phase immediately after the solidification, as well as the crystallized compound, the Co atoms forming a solid solution are present. Immediately after the solidification, the supersaturating Co atoms, which are higher in concentration than thermal equilibrium solid solubility, form the solid solution in the Al phase. However, since the Co atoms diffuse at a high rate in the Al phase, the Co atoms forming the supersaturated solid solution aggregate in a relatively short time to form the compound phase. As a result, after the casting and the solidification, by the time the cast rod is cooled to room temperature, most of the added Co atoms are present as the compound phase with the Al, with the Co atoms forming the solid solution in the Al phase being reduced to a low concentration of lower than 0.1% close to thermal equilibrium concentration.

On the other hand, the Zr in the Al phase has its diffusion rate significantly lower than the self-diffusion rate of the Al, and so becomes lower in the precipitation rate in the Al structure than the Co. Moreover, the maximum solid solubility in thermal equilibrium state of the Zr in the Al phase is on the order of 0.3 to 0.4%, which is several times higher than the maximum solid solubility in thermal equilibrium state of the Co in the Al phase. For this reason, the Zr has a low tendency to crystallize out at the stage of the cast rod after the casting, so most of the Zr is present in the form of a supersaturated solid solution in the Al structure. Further, since the Zr diffuses significantly slowly compared to the Co, the Zr remains maintained in the supersaturated solid solution state even when the cast rod after the casting is held at room temperature for a long time. The Zr in the supersaturated solid solution state can be precipitated by the aging treatment heating at a temperature of, for example, 300 degrees C. or higher.

From this, the present inventors have considered that when the molten metal is solidified before the Zr beginning to crystallize out, the Zr can be kept in the solid solution state, and so have studied the rate of cooling the molten metal. As a result, it has been found out that, with an increase in the rate of cooling the molten metal, in the resulting cast rod, it is possible to allow most of the Co to be crystallizing out as the Al—Co—Fe compound, but the Zr to be suppressed from crystallizing out and maintained in the solid solution state. By allowing the Zr to form the solid solution, it is possible to suppress the occurrence of a lowering in the ductility of the cast rod due to the Zr crystallizing out. That is, with the cast rod small in the amount of the Zr crystallizing out, as compared to the cast rod with the Zr crystallized therein, it is possible to suppress the occurrence of a wire break even when drawing the cast rod into a wire at a high degree of processing, and it is therefore possible to produce the alloy wire rod thin in wire diameter. Further, as will be described in detail later, it is possible to, in the final produced alloy wire rod, achieve the strength, the elongation, the electrical conductivity, and the heat resistance at a high level and in a well-balanced manner.

Moreover, by setting the temperature of the molten metal at not lower than 850 degrees C., it is possible to increase the limit of the solid solution of the Zr in the Al. As a result, even when the Zr content is increased from 0.5% by mass to 1.0% by mass for example, it is possible to allow the Zr to remain in the form of a solid solution without crystallizing out the Zr. Note that as long as it is possible to allow the Zr to form the solid solution, the upper limit of the temperature of the molten metal is not particularly limited, but may be set at for example, not higher than 900 degrees C., and is preferably set at not higher than 870 degrees C.

The metallographic structure of the cast rod produced in the casting step is mainly composed of the first Al crystal grains, which are surrounded by the high-angle tilt crystal grain boundaries. At the high-angle tilt grain boundaries, the Co is crystallized by forming the Al—Co—Fe compound with the Fe. The formation of the Al—Co—Fe compound allows making small the amount of the Fe in the solid solution state in the Al phase that causes the lowering of the electrical conductivity, and making small the amount of the precipitated product ($FeAl_3$) that causes the lowering of the elongation, as well. Note that the Zr is in the state of the solid solution in the Al phase or in the high-angle tilt grain boundaries without crystallizing out.

Note that, unlike the $FeAl_3$ compound lowering the ductility of the Al alloy, the Al—Co—Fe compound does not lower the ductility of the Al alloy, and therefore does not lead to failure to make the alloy wire rod thin in diameter. Note that the Al—Co—Fe compound is the compound containing at least the Al, the Co, and the Fe, and may also contain an other metal element. Further, the Al—Co—Fe compound is formed in an elongated shape in the ingot after the casting.

Further, in the casting step, the molten metal drained out from the molten metal pouring nozzle of the holding bath may lower in temperature before it is poured into the mold, which may cause the Zr forming the solid solution in the Al to begin to crystallize out. For that reason, from the viewpoint of suppressing the Zr crystallizing out from occurring between the holding bath and the mold, it is preferable to heat the molten metal to be poured into the mold, and thereby maintain the temperature of the molten metal in such a manner that the molten metal remains at a temperature of not lower than 850 degrees C. This makes it possible to more securely suppress the lowering of the temperature during the pouring of the molten metal, and therefore makes it possible to enhance the various properties of the alloy wire rod.

The method to heat the molten metal drained out from the molten metal pouring nozzle is not particularly limited, but it is possible to use a known heating means such as a burner, a radio wave heating device, a high frequency heating device or the like between the molten metal pouring nozzle and the mold. These heating means may be provided between the molten metal pouring nozzle and the mold so as to be able to heat the molten metal flowing down from the molten metal pouring nozzle.

In the casting step, from the viewpoint of solidifying the molten metal while allowing the Zr to remain in the form of the solid solution, the cooling rate for the subsequent rapid cooling of the molten metal is preferably set at not lower than 20 degrees C./s, and may be set at 50 degrees C./s, for example. The upper limit of the cooling rate for the subsequent rapid cooling of the molten metal is not particularly limited, but may be set at not higher than 200 degrees C./s. From the viewpoint of more securely achieving such a molten metal cooling rate, a Properzi type continuous casting machine rather than a twin roll type one may be used. Note that the molten metal cooling rate may be adjusted by appropriately altering the thickness of the mold. For example, by increasing the thickness of the mold, the ratio of the cross-sectional area of the mold to the cross-sectional area of the space of the mold (the cross-sectional area of the cast rod) may be increased to enhance the heat removal efficiency. Further, the molten metal cooling rate is defined as a value obtained by dividing a difference between a temperature (for example, 850 degrees C.) of the molten metal at which the molten metal is poured into the mold and a temperature at which the molten metal poured into the mold is solidified, by a time taken for the molten metal to be poured into the mold and then solidified.

(Molding Step)

Subsequently, as necessary, the cast rod is molded into a rod shape (so-called wire rod) so that the cast rod is easy to draw into a wire (S3). Herein, for example, the cast rod is subjected to a plastic forming process so that the wire diameter becomes 5 mm to 50 mm. As the plastic forming, for example, a conventionally known method such as a rolling process, a swaging process, a pulling out process or the like may be performed.

(Wire Drawing Step)

Subsequently, the rod-shaped cast rod is subjected to a cold wire drawing process to form a drawn wire rod having a predetermined wire diameter (S4). The wire drawing process may be performed by a conventionally known method such as a wire pull out drawing process using a die, or the like. Note that the degree of processing in the wire drawing step refers to the area reduction rate in the wire drawing step, which is defined as the ratio of the difference between the cross-sectional area of the cast rod and the cross-sectional area of the drawn wire rod to the cross-sectional area of the cast rod.

In the metallographic structure of the drawn wire rod produced in the wire drawing step, the Al crystal grains are drawn in the wire drawing direction by the wire drawing process, in such a manner that a processing strain is introduced into the high-angle tilt crystal grain boundaries. In addition, the Al—Co—Fe compound being dispersed in the cast rod is finely pulverized by the wire drawing process, in such a manner that the Al—Co—Fe compound is finely and densely dispersed in the metallographic structure of the drawn wire rod.

In the present embodiment, since the cast rod has its high ductility by the Zr being suppressed from crystallizing out, the degree of processing in the wire drawing process can be made high. From the viewpoint of more finely pulverizing the Al—Co—Fe compound and more finely dispersing it in the drawn wire rod, it is preferable that the cast rod is drawn into a wire in such a manner that its cross-sectional area is reduced by 0.01 times or smaller, to reduce the drawn wire rod to 2.0 mm or thinner in wire diameter. By setting such a degree of processing, the size of the Al—Co—Fe compound after the completion of the wire drawing is easily controlled to be set at 20 nm to 1 μm. In addition, when Zr is precipitated in the aging treatment step described later, the size of the Al—Zr compound is easily controlled to be set at 1 nm to 100 nm. Moreover, in the final alloy wire rod, the precipitates can be further dispersed and precipitated.

In the present embodiment, since the cast rod has its high ductility, it is possible to omit an annealing treatment (so-called intermediate annealing treatment) for mitigating the processing strain in the wire drawing. This makes it possible to further suppress the coarsening due to the recrystallization of the Al crystal grains.

(Aging Treatment Step)

Subsequently, the drawn wire rod is subjected to an aging treatment (S5) to produce the alloy wire rod of the present embodiment.

In the aging treatment, the Zr forming a solid solution in the Al phase is precipitated as the Al—Zr compound, while the processing strain introduced into the metallographic structure of the drawn wire rod is mitigated. In the present embodiment, since the Co compound is being finely dispersed in the drawn wire rod, it is possible to mitigate the processing strain by a recovery of the Al crystal while suppressing the occurrence of a recrystallization of the Al. This makes it possible to promote the formation of the low-angle tilt crystal grain boundaries resulting from the recovery of the Al crystal, while reducing the creation or growth of the high-angle tilt crystal grain boundaries resulting from the recrystallization of the Al. This can result in the alloy wire rod having the metallographic structure described above.

Here, the formation of the grain boundaries when the processing strain is mitigated will be described.

As described above, the processing strain is introduced into the aluminum alloy constituting the drawn wire rod in the process of wire drawing the cast rod into the drawn wire rod. The processing strain is caused by accumulation of lattice defects called so-called dislocations. In the aluminum alloy, its stacking fault energy is high, so a large number of dislocations introduced by the processing move in the crystal to form an aggregate rather than being separated from each other and present as each single linear defect in the crystal. As a result, the metallographic structure of the drawn wire rod is formed with a structure called a dislocation cell structure in which regions with the dislocations being densely packed therein and regions with the dislocations being sparsely packed therein are periodically distributed.

When this wire rod is subjected to the aging treatment, by the crystal recovery or the recrystallization occurring, the processing strain is mitigated.

The crystal recovery occurs by the dislocation cells being moved and rearranged by heating. In the crystal recovery, the first Al crystal grains themselves surrounded by the high-angle tilt crystal grain boundaries are not grown, but sub-grain boundaries are formed within the first Al crystal grains. The sub-grain boundaries refer to the low-angle tilt crystal grain boundaries having a small crystal orientation difference. By the formation of the sub-grain boundaries, the second Al crystal grains surrounded by the low-angle tilt crystal grain boundaries are formed within the first Al crystal grains. And, with the aging treatment time elapsing, the sub-grain boundaries move within the first Al crystal grains, thereby allowing the second Al crystal grains to grow and increase in size. In this manner, in the alloy wire rod produced by the aging treatment, by the plurality of the second Al crystal grains being grown within the first Al crystal grains, the first Al crystal grains form the structure divided by the second Al crystal grains. By the formation of such a structure, the processing strain is mitigated and decreased.

On the other hand, in the recrystallization, nucleation of strain-free new crystal grains (recrystallized grains) occurs in the metallographic structure. With the aging treatment time elapsing, the recrystallized grains grow while absorbing surrounding strains. Crystal grain boundaries formed by the recrystallized grains are the high-angle tilt crystal grain boundaries having a large crystal orientation difference. By the recrystallized grains growing and the high-angle tilt crystal grain boundaries moving, the dislocation cells or the second Al crystal grains dissipate in regions after the high-angle tilt crystal grain boundaries moving. For that reason, when the recrystallization occurs in the drawn wire rod, a plurality of the fine recrystallized grains, which are surrounded by the high-angle tilt crystal grain boundaries, are formed in the metallographic structure of the alloy wire rod. The recrystallized grains have no lattice defects that cause strains such as the second Al crystal grains surrounded by the low-angle tilt crystal grain boundaries, the dislocation cells or the like.

In this manner, the processing strain is relieved by the crystal recovery and the recrystallization. Since the recrystallized grains have no lattice defect, the metallographic structure with the recrystallization occurring therein becomes high in the degree of the reduction of the processing strain, as compared to the metallographic structure with the recovery occurring therein. For that reason, the properties such as the strength, the tensile strength and the like deteriorate with an increase in the recrystallized grains. In the present embodiment, the strength and the like can be maintained at a high level by the aging treatment suppressing the recrystallization and promoting the recovery.

A reason for the aging treatment being able to suppress the recrystallization and promote the recovery is because the Al—Co—Fe compound and the Al—Zr compound are being finely dispersed in the metallographic structure. Here, the actions of these compound grains will be described.

The Al—Co—Fe compound grains and the Al—Zr compound grains are considered to influence the form of the metallographic structure by the following two actions.

One action is to pin the crystal grain boundaries in the metallographic structure. By pinning the crystal grain boundaries, it is possible to suppress the grain boundary movement due to the heating and finely stabilize the crystal grains.

The other action is to form a densely packed strain region (so-called deformation band) around the grains. The deformation band refers to an aggregate of fine dislocation cells having a size of several hundreds nm or less, with a large number of dislocations being densely packed therein. The individual fine cells constituting the deformation band are characterized in that the orientation difference between adjacent fine cells is around 15 degrees or more, so the orientation difference is relatively large. For this reason, in the deformation band, a recrystallized structure different in orientation difference from the surrounding Al crystal tends to be produced during heating, so recrystallized grains tend to be created. That is, the Al—Co—Fe compound grains and the Al—Zr compound grains have a tendency to produce the deformation band therearound and promote the recrystallization when heated. Note that, as the Al—Co—Fe compound grains and the Al—Zr compound grains become smaller, the deformation band is less likely to be formed around those compound grains, and therefore the recrystallization is less likely to occur.

In the drawn wire rod, since the Al—Co—Fe compound is crystallizing out, the recrystallization tends to be promoted around the grains of the Al—Co—Fe compound. However, in the present embodiment, during the aging treatment, the recrystallization can be suppressed by precipitating the Zr forming a solid solution in the Al phase as the Al—Zr compound. Specifically, in the initial stage (for example, less than 1 hour) of the aging treatment, the Al—Zr compound is dispersed in a fine-grained state and precipitated around the crystallized coarse Al—Co—Fe compound. That is, the Al—Zr compound can be precipitated around the Al—Co—Fe compound at a high number density. Around the fine-grained Al—Zr compound, the deformation band is less likely to be formed and so the nucleation of the recrystallized grains is less likely to occur. Even if the recrystallized grains are created around the Al—Co—Fe compound, the growth thereof is inhibited (pinned) by the Al—Zr compound dispersed and precipitated around the Al—Co—Fe compound at a high number density, and therefore the coarsening of the recrystallized grains can be suppressed. In this manner, with the Al—Co—Fe compound and the Al—Zr compound, it is possible to promote the crystal recovery resulting from the heat treatment while suppressing the recrystallization.

The conditions for the aging treatment are not particularly limited, but the temperature for heating the drawn wire rod is preferably set at 300 degrees C. to 400 degrees C. By setting the temperature of the aging treatment at 300 degrees C. or higher, the sub-grain boundaries can be formed and grown, so the ductility of the alloy wire rod can be enhanced. In addition, since the Al—Zr compound is easily precipitated, it is possible to enhance the strength of the alloy wire rod while keeping the electrical conductivity of the alloy wire rod high. On the other hand, by setting the temperature of the aging treatment at 400 degrees C. or lower, the recrystallization can be suppressed and the sub-grain boundaries can be maintained without being dissipated, and so the strength of the alloy wire rod can be maintained at a high level.

In addition, the time (treatment time) for heating the drawn wire rod in the aging treatment is preferably set at 10 hours to 100 hours. By setting the heat treatment time at 10 hours to 100 hours, it is possible to sufficiently precipitate the Al—Zr compound while keeping the production cost low, and to make the electrical conductivity of the alloy wire rod high and make the strength of the alloy wire rod high.

[Advantageous Effects of the Present Embodiment]

According to the present embodiment, one or more of the following advantageous effects are achieved.

In the present embodiment, the molten metal having the above-described chemical composition is adjusted in such a manner that its temperature becomes not lower than 850 degrees C., and the molten metal is then introduced into the mold, and in that mold, the molten metal is rapidly cooled at such a cooling rate as to allow the Co to crystallize out while suppressing the Zr from crystallizing out. By increasing the molten metal temperature, the limit of the solid solution of the Zr can be increased, and so the Zr can be further suppressed from crystallizing out. Moreover, by rapidly cooling the molten metal of such a temperature, the Co is dispersed in the solidified structure as the Al—Co—Fe compound, while the Zr is allowed to remain in the form of the solid solution in the Al phase, and is suppressed from crystallizing out, thereby resulting in the cast rod. By drawing this cast rod into a wire, the drawn wire rod is formed with the Al—Co—Fe compound being pulverized, fine grained, and uniformly dispersed therein. Then, by subjecting the drawn wire rod to the aging treatment, the Zr forming a solid solution in the Al phase is precipitated as the Al—Zr compound. In the aging treatment, with the Zr precipitating, the recrystallized grains may be created by recrystallization, but the recrystallization is suppressed by the Al—Co—Fe compound finely dispersed in the drawn wire rod, while the processing strain can be relaxed by crystal recovery. This makes it possible to, in the final produced alloy wire rod, make small the number of the recrystallized grains, and allow each of the Al—Co—Fe compound and the Al—Zr compound to be finely dispersed.

The resulting alloy wire rod has the above-mentioned compound composition, and has the metallographic structure including the Al crystal grains, and the Al—Co—Fe compound and the Al—Zr compound as the dispersed grains. Specifically, when the crystal orientation analysis of the cross section parallel to the longitudinal direction of the alloy wire rod is performed by the EBSD, the metallographic structure includes the high-angle tilt crystal grain boundaries, and the low-angle tilt crystal grain boundaries, and the average grain diameter of the Al crystal grains (the first Al crystal grains), which are surrounded by the high-angle tilt crystal grain boundaries, is 12 μm or more, while the average grain diameter of the Al crystal grains (the first Al crystal grains), which are surrounded by the high-angle tilt crystal grain boundaries, the Al crystal grains, which are surrounded by the high-angle tilt crystal grain boundaries and the low-angle tilt crystal grain boundaries, and the Al crystal grains, which are surrounded by the low-angle tilt crystal grain boundaries, is 10 μm or less. Such a metallographic structure makes it possible to suppress the recrystallization and make small the number of the recrystallized grains having no strain, and on the other hand, makes it possible to allow the recovery to relax the processing strain and the metallographic structure to have a moderate strain.

The alloy wire rod having such a metallographic structure has its properties shown below. That is, since the Fe is being dispersed in the form of the Al—Co—Fe compound rather than the $FeAl_3$ compound, the lowering in the strength and the elongation due to the $FeAl_3$ are being suppressed. Further, by allowing the Fe to be absorbed by the compound, the amount of the Fe forming a solid solution in the Al phase is small, and the high electrical conductivity can be maintained. Further, since the Al—Zr compound is precipitated, the high heat resistance can be achieved. In addition, in the metallographic structure, by making small the number of the recrystallized grains having no strain while allowing the recovery to relax the processing strain and the metallographic structure to have a moderate strain, it is possible to achieve the desired strength (hardness) and the tensile strength. Furthermore, by finely dispersing the grains made of each compound of the Al—Co—Fe compound and the Al—Zr compound in the alloy with the Al crystal grains set at a micro size, the effect of each grain can be achieved at a high level and in a well-balanced manner. Note that the wire rod with the processing strain being relieved by the recovery and the wire rod with the processing strain being relieved by the recrystallization are different in strength for the following reason. In the case of the recrystallization, with the growth of the recrystallized grains, the recrystallized grains absorb and dissipate the surrounding processing strain as the driving force (the energy) for the grain boundary movement. For this reason, substantially no strain (lattice defect such as dislocation or the like or elastic strain of the crystal lattice itself) is included within the recrystallized grains. On the other hand, in the case of the recovery, a certain amount of processing strain remains in the wire rod. For that reason, in comparing metallographic structures with substantially the same crystal grain diameters, the metallographic structure with the processing strain being relaxed by the recovery becomes large in the amount of strain remaining within the crystal grains, and high in the strength of the wire rod as well, as compared to the metallographic structure with the processing strain being relieved by the recrystallization.

The alloy wire rod of the present embodiment specifically has the following properties. That is, the tensile strength is 180 MPa or higher, the tensile elongation is 10% or higher, the electrical conductivity is 53% IACS or higher, and the strength when heated at 200 degrees C. for 10 years or longer is 90% or higher of the initial strength, and the strength, the elongation, the electrical conductivity and the heat resistance can be achieved at a high level and in a well-balanced manner.

From the viewpoint of achieving the strength, the elongation, the electrical conductivity and the heat resistance at a higher level and in a well-balanced manner, the alloy wire rod preferably has the metallographic structure configured as follows. That is, when a crystal orientation analysis is performed by the EBSD on a cross section parallel to the longitudinal direction of the alloy wire rod, the resulting metallographic structure includes the high-angle tilt crystal grain boundaries, and the low-angle tilt crystal grain boundaries, and the average grain diameter of the Al crystal grains (the first Al crystal grains), which are surrounded by the high-angle tilt crystal grain boundaries, is 12 μm or more, while the average grain diameter of the Al crystal grains (the first Al crystal grains), which are surrounded by the high-angle tilt crystal grain boundaries, the Al crystal grains, which are surrounded by the high-angle tilt crystal grain boundaries and the low-angle tilt crystal grain boundaries, and the Al crystal grains, which are surrounded by the low-angle tilt crystal grain boundaries, is 10 μm or less.

Further, the alloy wire rod preferably has an Al—Zr compound size of 1 nm or more and 100 nm or less. By reducing the size of the Al—Zr compound, the elongation of the alloy wire rod can be further enhanced and the wire break rate in the producing process can be reduced. As a result, the yield of the alloy wire rod can be enhanced.

Further, the alloy wire rod preferably has an Al—Co—Fe compound size of not smaller than 20 nm and not larger than 1 μm. When the size of the Al—Co—Fe compound falls within this range, the coarsening of the Al crystal grains can efficiently be suppressed. This makes it possible to achieve both the ductility and the strength at a high level and in a well-balanced manner in the alloy wire rod.

Moreover, in the present embodiment, the Zr is suppressed from crystallizing out in the cast rod, and its ductility is kept high. For that reason, it is possible to perform the wire drawing at a high degree of processing in the wire drawing step, and it is possible to make the alloy wire rod thin in diameter while maintaining the balance of the various properties of the alloy wire rod at a high level. Specifically, the wire diameter can be set at 2 mm or thinner.

Further, in the present embodiment, since the Zr is suppressed from crystallizing out in the cast rod and its ductility is kept high, the occurrence of a wire break due to the processing strain in the drawn wire rod can be reduced. Moreover, since the ductility of the drawn wire rod is also high, it is possible to omit the annealing treatment for relieving the processing strain.

Further, in the present embodiment, it is preferable that the precipitates are spherical. By making the precipitates spherical, when the stress is concentrated in a part of the alloy wire rod due to a deformation, it is possible to suppress the occurrence of a cracking at the interfaces between the Al phase and the precipitates, and it is therefore possible to enhance the ductility of the alloy wire rod.

Further, in the present embodiment, when the aging treatment is performed on the drawn wire rod, the crystallized product of the Co suppresses the recrystallization of the Al crystal grains and maintains the Al crystal grains in a small grain diameter. For that reason, the crystal grain boundaries between the Al crystal grains have a fine mesh structure, and therefore it is possible to shorten the time taken for the Zr forming the solid solution to move from the Al phase to the crystal grain boundaries and precipitate. As a result, it is possible to shorten the aging treatment and thereby enhance the production efficiency for the alloy wire rod.

Also, it is preferable that the molten metal drained out from the molten metal pouring nozzle of the holding bath is maintained at a temperature of not lower than 850 degrees C. by heating until the molten metal is poured into the mold. This makes it possible to suppress the occurrence of a lowering in the temperature of the molten metal during a time taken for the molten metal to be poured from the holding bath into the mold. For that reason, the molten metal can be poured into the mold with the crystallized amount of the Zr being made smaller. As a result, it is possible to further reduce the amount of the Zr crystallizing out in the cast rod, and it is therefore possible to achieve the various properties of the final produced alloy wire rod at a higher level and in a well-balanced manner.

Also, during casting the molten metal, the molten metal cooling rate is preferably not lower than 20 degrees C./s. By rapidly cooling the molten metal in such a condition, it is possible to more finely disperse and crystallize out the Co while more securely suppressing the Zr from crystallizing out. As a result, it is possible to achieve the balance of the various properties of the final produced alloy wire rod at a higher level.

Also, in the wire drawing, it is preferable to draw the cast rod into a wire at such a degree of processing that its cross-sectional area is reduced by 0.01 times or smaller. By wire drawing at such a degree of processing, it is possible to more finely pulverize, fine grain, and uniformly disperse the Al—Co—Fe compound crystallizing out in the cast rod. As a result, in the aging treatment, it is possible to more finely disperse and precipitate the Al—Zr compound, and it is therefore possible to achieve the balance of the various properties of the final produced alloy wire rod at a higher level.

Other Embodiments

Although, in the above-described embodiment, the alloy wire rod using the Co and the Zr as the alloy elements has been described, the present invention is not limited to this, but Ni can be used in place of the Co.

In the alloy wire rod producing process (in the process of casting), most of the Ni reacts with the Al to form a crystallized product (an Al—Ni compound), so the Ni is present in the final produced alloy wire rod in the form of the compound phase. The Al—Ni compound is actually present in the form of an Al—Ni—Fe compound with the Fe absorbed therein, which is unavoidably present in the aluminum alloy. The Al—Ni—Fe compound contributes to the fine graining of Al recrystallized grains in the alloy and allows an enhancement in the elongation of the alloy wire rod. Although the Ni may lower the electrical conductivity of the alloy, by setting the Ni content at 0.1% by mass to 1.0% by mass, it is possible to allow the Ni to produce the effect of having the strength, the elongation, and the heat resistance at a high level and in a well-balanced manner while suppressing the lowering of the electrical conductivity due to the Ni in the alloy wire rod. The Ni content is preferably 0.2% by mass to 1.0% by mass, and more preferably 0.3% by mass to 0.8% by mass.

When the alloy wire rod is produced by using the Ni, it may be produced in the same manner as when produced by using the Co. Further, the resulting alloy wire rod has the same metallographic structure as that of the alloy wire rod using the Co and has the above-described properties.

EXAMPLES

Next, the present invention will be described in more detail based on examples, but the present invention is not limited to these examples.

<Alloy Wire Rod Production>

Example 1

In Example 1, 99.7% purity aluminum, Co, and Zr were compounded with composition of Co, Zr, Fe, and Si shown in Table 1 below, and were melted in an argon atmosphere using a high frequency melting furnace. After adjusting the temperature of the resulting molten metal at 850 degrees C., the molten metal was poured into a copper water-cooled mold (inner diameter: 15 mm) and cast, resulting in a cast rod having a predetermined chemical composition. In the present Example, a burner was installed so as to be able to heat the molten metal poured in, and the temperature of the molten metal poured in was maintained in such a manner as to be not lower than 850 degrees C. Further, the rate of cooling the molten metal was set at 50 degrees C./SEC (seconds). The cast rod was circular columnar in shape whose dimensions were 15 mm in outer diameter and 150 mm in length. This cast rod was made by a swaging process into a wire rod of 9.5 mm diameter, and then the wire rod was repeatedly subjected to a wire pull out drawing process with a die and reduced to 0.45 mm in diameter. No intermediate heat treatment was performed during the wire drawing process with the die. The resulting 0.45 mm diameter wire rod was held in a salt bath heated and held at 350 degrees C. for 20 hours or longer, to thereby perform an aging heat treatment. This results in an alloy wire rod of Example 1.

TABLE 1

| | Chemical composition (% by mass) | | | | | Cooling Rate | Elongation | Tensile Strength | Electrical conductivity | Heat | Average grain size of Al crystal grains (μm) | | Forms of Compound | |
|---|---|---|---|---|---|---|---|---|---|---|---|---|---|---|
| | Co | Zr | Fe | Ni | Si | (° C./s) | (%) | (MPa) | (% IACS) | resistance | ≥15° | ≥2° | Crystallized phase | Precipitated phase |
| Example 1 | 0.6 | 0.4 | 0.15 | — | 0.1 | 50 | 18 | 195 | 56 | ○ | 13 | 6 | AlCoFe | AlZr |
| Example 2 | 0.6 | 0.6 | 0.15 | — | 0.1 | 50 | 15 | 215 | 54 | ○ | 15 | 4 | AlCoFe | AlZr |
| Example 3 | 0.6 | 0.8 | 0.15 | — | 0.1 | 50 | 13 | 245 | 53 | ○ | 13 | 3 | AlCoFe | AlZr |
| Example 4 | 0.2 | 0.4 | 0.15 | — | 0.1 | 50 | 11 | 187 | 57 | ○ | 18 | 6 | AlCoFe | AlZr |
| Example 5 | 0.4 | 0.4 | 0.15 | — | 0.1 | 50 | 12 | 190 | 57 | ○ | 15 | 5 | AlCoFe | AlZr |
| Example 6 | 0.6 | 0.4 | 0.15 | — | 0.1 | 25 | 19 | 186 | 57 | ○ | 16 | 5 | AlCoFe | AlZr |
| Example 7 | 0.6 | 0.6 | 0.15 | — | 0.1 | 25 | 16 | 199 | 55 | ○ | 18 | 6 | AlCoFe | AlZr |
| Example 8 | 0.6 | 0.8 | 0.15 | — | 0.1 | 25 | 13 | 222 | 54 | ○ | 15 | 4 | AlCoFe | AlZr |
| Example 9 | 0.4 | 0.4 | 0.15 | — | 0.1 | 30 | 13 | 181 | 56 | ○ | 19 | 7 | AlCoFe | AlZr |
| Example 10 | — | 0.4 | 0.15 | 0.4 | 0.1 | 50 | 20 | 187 | 56 | ○ | 16 | 7 | AlNiFe | AlZr |
| Example 11 | — | 0.6 | 0.15 | 0.4 | 0.1 | 50 | 16 | 195 | 54 | ○ | 15 | 4 | AlNiFe | AlZr |
| Example 12 | — | 0.4 | 0.15 | 0.3 | 0.1 | 50 | 19 | 182 | 53 | ○ | 12 | 3 | AlNiFe | AlZr |

Examples 2 to 5

In Examples 2 to 5, alloy wire rods were produced in the same manner as in Example 1 except that the addition amounts of the Co and the Zr were altered with compositions shown in Table 1.

Examples 6 to 9

In Examples 6 to 9, alloy wire rods were produced in the same manner as in Example 1 except that the addition amounts of the Co and the Zr were altered with compositions shown in Table 1, and the rate of cooling the molten metal was set at 25 degrees C./s (seconds) or 30 degrees C./s (seconds). Note that the rate of cooling the molten metal was adjusted by reducing the temperature of the molten metal during the casting to 800 degrees C.

Examples 10 to 12

In Examples 10 to 12, alloy wire rods were produced in the same manner as in Example 1 except that Ni was used in place of the Co as shown in Table 1.

Comparative Examples 1 to 6

In Comparative Examples 1 to 6, alloy wire rods were produced in the same manner as in Example 1 except that the chemical compositions of the Co and the Zr and the like were altered as shown in Table 2 below, and the rate of cooling the molten metal was altered from 50 degrees C./s to 10 degrees C./s. Note that the rate of cooling the molten metal was adjusted by reducing the temperature of the molten metal during casting to 800 degrees C. and setting the inner diameter of the copper water-cooled mold at a diameter of 30 mm.

Comparative Examples 7 and 8

In Comparative Examples 7 and 8, as shown in Table 2 below, alloy wire rods were produced in the same manner as in Comparative Example 1 except that Ni was used in place of the Co.

TABLE 2

| | Chemical composition (% by mass) | | | | | Cooling Rate | Elongation | Tensile Strength | Electrical conductivity | Heat resistance | Average grain size of Al crystal grains (μm) | | Forms of Compound | |
|---|---|---|---|---|---|---|---|---|---|---|---|---|---|---|
| | Co | Zr | Fe | Ni | Si | (° C./s) | (%) | (MPa) | (% IACS) | | ≥15° | ≥2° | Crystallized phase | Precipitated phase |
| Comparative Example 1 | 0.6 | 0.2 | 0.15 | — | 0.1 | 10 | 27 | 145 | 59 | X | 9 | 6 | AlCoFe | AlZr |
| Comparative Example 2 | 0.6 | 0.4 | 0.15 | — | 0.1 | 10 | 25 | 152 | 58 | X | 6 | 3 | AlCoFe | AlZr |
| Comparative Example 3 | 0.6 | 0.6 | 0.15 | — | 0.1 | 10 | 20 | 156 | 56 | ○ | 8 | 4 | AlCoFe | AlZr |
| Comparative Example 4 | 0.6 | 0.8 | 0.15 | — | 0.1 | 10 | 20 | 159 | 55 | ○ | 7 | 4 | AlCoFe | AlZr |
| Comparative Example 5 | 0.2 | 0.4 | 0.15 | — | 0.1 | 10 | 17 | 143 | 59 | X | 8 | 6 | AlCoFe | AlZr |
| Comparative Example 6 | 0.4 | 0.4 | 0.15 | — | 0.1 | 10 | 21 | 148 | 58 | X | 6 | 3 | AlCoFe | AlZr |
| Comparative Example 7 | — | 0.4 | 0.15 | 0.4 | 0.1 | 10 | 23 | 137 | 58 | X | 8 | 5 | AlNiFe | AlZr |
| Comparative Example 8 | — | 0.6 | 0.15 | 0.4 | 0.1 | 10 | 25 | 142 | 56 | ○ | 6 | 4 | AlNiFe | AlZr |

<Evaluation Method>

The produced alloy wire rods were evaluated for the metallographic structure, the forms of the compounds dispersed in the metallographic structure, the elongation, the tensile strength, the electrical conductivity, and the heat resistance by the following method.

(Metallographic Structure)

The grain boundary structure was analyzed by the EBSD for the metallographic structures of the resulting alloy wire rods. Specifically, the alloy wire rods were cut parallel to their length direction, and their cross sections were polished, and then the crystal orientation mapping was performed by the EBSD. The distance between the measurement points in the mapping was set at 0.2 μm, and the orientation distribution in a 50 μm×70 μm region was measured. By analyzing the orientation data obtained by the mapping, the shapes of the high-angle tilt crystal grain boundaries with an orientation difference of 15 degrees or more and the low-angle tilt crystal grain boundaries with an orientation difference of 2 degrees or more and less than 15 degrees were depicted. At this point of time, a region surrounded by the high-angle tilt crystal grain boundaries was defined as a first Al crystal grain, while a region surrounded by the low-angle tilt crystal grain boundaries was defined as a second Al crystal grain. The crystal grain diameter of each crystal grain was measured by using an analyzer (software available from TSL Solutions, Inc.: OIM ver 6.20). Specifically, the area of each crystal grain present in the metallographic structure obtained by the crystal orientation analysis by the EBSD was calculated by the analyzer, and when the calculated area was assumed as the area of a circle, the diameter of the circle was taken as the diameter of a crystal grain, and the average value of the crystal grain diameters was taken as the average grain diameter. In the present examples, the average grain diameter of the first Al crystal grains, which were surrounded by the high-angle tilt crystal grain boundaries where the crystal orientation difference was 15 degrees or more, and the average grain diameter of the Al crystal grains, which were surrounded by the crystal grain boundaries where the crystal orientation difference was 2 degrees or more, (the Al crystal grains, which were surrounded by the high-angle tilt crystal grain boundaries, the Al crystal grains, which were surrounded by the high-angle tilt crystal grain boundaries and the low-angle tilt crystal grain boundaries, and the Al crystal grains, which were surrounded by the low-angle tilt crystal grain boundaries), were measured. Note that in the crystal orientation analysis made by the EBSD, only the measurement data having a CI (Confidence Index) value of 0.1 or more, which was an index indicating the reliability of the measurement points, were analyzed.

(Forms of the Compounds)

The forms of the compounds dispersed in the metallographic structures of the alloy wire rods were observed by obtaining a thin film test material from a cross section parallel to a longitudinal direction with a focused ion beam (FIB) instrument and observing the thin film test material with a STEM (scanning transmission electron microscope). For observation, the STEM instrument having a field emission (FE) type electron beam source was used, and a high angle annular dark field image (High Angle Dark Field image, HAADF) was photographed and fine compound grains including Co, Ni, Fe, and Zr were observed. At this point of time, a grain made of compounds containing Co, Ni, and Fe (i.e., Al—Co—Fe compound and Al—Ni—Fe compound) was used as a crystallized phase, while a grain made of a compound containing only Zr (i.e., Al—Zr compound) was used as a precipitated phase. Note that the crystallized phase, which is the grain made of the compound containing Co, Ni, and Fe, is an elliptical grain, and a maximum length of the individual grains was measured in an observation region (10 μm×10 μm), and its value was defined as the size of the crystallized phase. In the measurement results, the sizes of the crystallized phases were distributed in a range where the maximum length was 20 nm or more and 1 μm or less. Further, the precipitated phase, which is the grain made of the compound containing only Zr, is a finer rod shape or granular grain than the crystallized phase, and the maximum length of the individual grains was measured in the observation region (10 μm×10 μm), and its value was defined as the size of the crystallized phase. In the measurement results, most of the sizes of the precipitated phases were distributed in a range of the maximum length of 1 nm to 100 nm.

(Elongation and Tensile Strength)

The elongation and tensile strength of the alloy wire rods were measured by a tensile test of the alloy wire rod (a test method in compliance with JIS Z 2241 (test speed: 20 mm/min)). In the present examples, when the elongation was 8% or higher, the elongation was evaluated as a high elongation. Further, when the tensile strength was 180 MPa or higher, the tensile strength was evaluated as a high strength.

(Electrical Conductivity)

The electrical conductivity of the alloy wire rods was calculated by measuring an electrical resistance of the produced alloy wire rod at 20 degrees C. by a direct current four-terminal method. In the present examples, when the electrical conductivity was 53% IACS or higher, the electrical conductivity was evaluated as a high electrical conductivity.

(Heat Resistance)

The heat resistance of the alloy wire rods was evaluated by the following method to evaluate the presence or absence of the heat resistance as to whether the strength when heated at 200 degrees C. for 10 years or longer was 90% or higher of the initial strength. First, the alloy wire rods were subjected to the aging treatment in which the heating temperature and the heating time were altered, and the tensile strength was measured from the tensile test of the wire rods after the aging treatment. The tensile test was performed on five wire rods having the same chemical compositions and aging conditions, and the average of the five test results was adopted as the tensile strength. Next, isothermal softening curves of the tensile strengths at various temperatures were created from the values of the heating temperature, the heating time, and the tensile strength. Next, from the isothermal softening curves, the time taken for the tensile strength to be decreased by 10% from the initial value (the value of the tensile strength before the heating) by the heating was determined. Next, the temperatures used and the times taken for the tensile strength to be decreased by 10% from the initial value, (the time taken for the tensile strength to be decreased by 10% from the initial value when heated at temperatures of 300 degrees C., 350 degrees C. and 400 degrees C.), were determined. By using these times and temperatures, an Arrhenius plot was obtained. Then, the time when the temperature on the resulting Arrhenius plot was 200 degrees C. (the time taken for the tensile strength to decrease by 10%) was determined. At this point of time, when the condition for the time being 10 years or longer at the Arrhenius plot of 200 degrees C. was satisfied, the heat resistance was determined as accepted (in Tables, denoted by ○) as the desired heat resistance, or when the time was less than 10 years at the Arrhenius plot of 200 degrees C., the heat resistance was determined as rejected (in Tables, denoted by x) as no desired heat resistance. Note that, in this measurement, it was assumed that all softening phenomena of 10% or less occurred with the same activation energy. Further, the tensile test of the alloy wire rods was measured by the above-described tensile test (the test method in compliance with JIS Z 2241 (test speed: 20 mm/min)).

<Evaluation Results>

The various properties of the alloy wire rods of Examples 1 to 12 were measured. As shown in Table 1, for all the alloy wire rods of Examples 1 to 12, it was confirmed that the tensile strength was 180 MPa or higher, the elongation was 10% or higher, the electrical conductivity was 53% IACS or higher, and that the heat resistance was accepted (○) as the time at 200 degrees C. was 10 years or longer.

On the other hand, in the alloy wire rods of Comparative Examples 1 to 8, as shown in Table 2, it was confirmed that the elongation was 10% or higher and that the electrical conductivity was 53% IACS or higher. However, it was confirmed that the tensile strength was as low as 137 MPa to 159 MPa.

In investigating the differences in the evaluation results between the examples and the comparative examples, it was confirmed that the differences in the properties resulted from the differences in the metallographic structures of the alloy wire rods.

Figure 2:
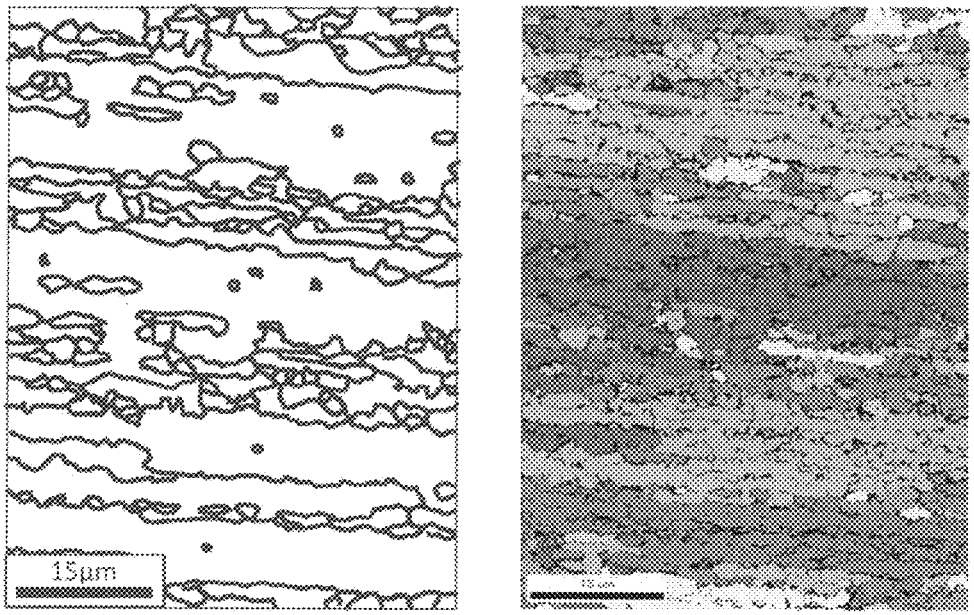
FIG. 2 is a diagram showing a crystal grain shape map obtained by extracting high-angle tilt crystal grain boundaries in FIG. 1.
Figure 3:
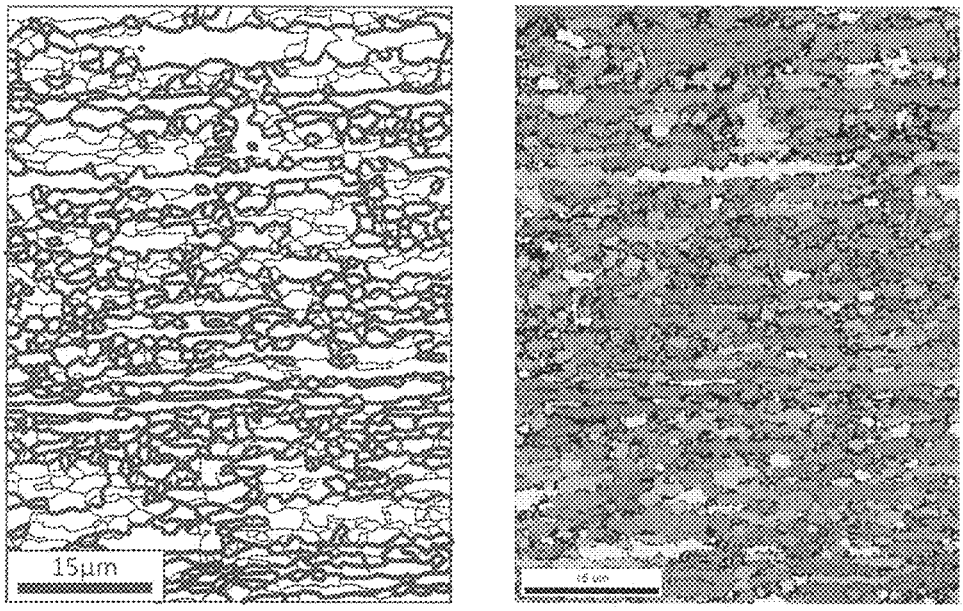
FIG. 3 is a diagram showing a crystal grain shape map obtained when an EBSD measurement is performed on a cross section parallel to a longitudinal direction for an alloy wire rod of Comparative Example 2.
Figure 4:
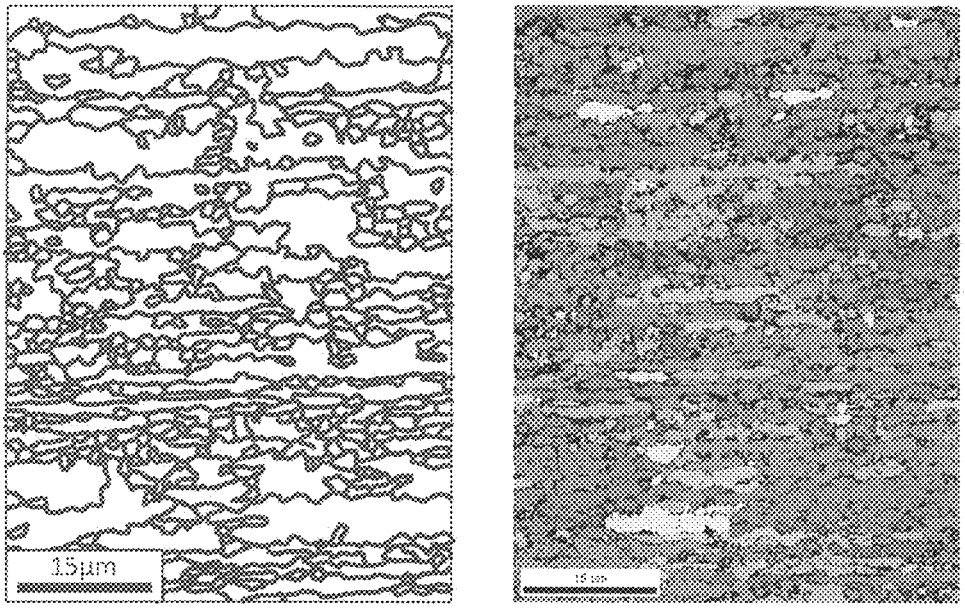
FIG. 4 is a diagram showing a crystal grain shape map obtained by extracting high-angle tilt crystal grain boundaries in FIG. 3; and, FIG. 5 is a flowchart showing respective steps of a method for producing an aluminum alloy wire rod in an embodiment according to the present invention.

FIG. 1 shows a map of a crystal grain shape obtained when the EBSD measurement was performed on a cross section parallel to the longitudinal direction of the alloy wire rod of Example 2. FIG. 2 shows a map of a crystal grain shape obtained by extracting the high-angle tilt crystal grain boundaries in FIG. 1. Further, FIG. 3 shows a map of a crystal grain shape obtained when the EBSD measurement was performed on a cross section parallel to the longitudinal direction of the alloy wire rod of Comparative Example 2. FIG. 4 shows a map of a crystal grain shape obtained by extracting the high-angle tilt crystal grain boundaries in FIG. 3. Note that the crystal grain shape maps shown in the left side of FIGS. 1 to 4 are the ones that distinctively illustrate the high-angle tilt crystal grain boundaries having an orientation difference of 15 degrees or more with bold lines, and the low-angle tilt crystal grain boundaries having an orientation difference of 2 degrees or more and less than 15 degrees with thin lines, in the crystal grain shape maps shown in the right side of FIGS. 1 to 4.

In FIG. 1, the inner part of the region surrounded by the thick line was displayed in such a manner as to be divided by the thin line. This showed that the first Al crystal grains, which were surrounded by the high-angle tilt crystal grain boundaries, were separated by the second Al crystal grains, which were surrounded by the low-angle tilt crystal grain boundaries. In this manner, the composite crystal structure in which the inner part of the high-angle tilt crystal grain boundaries was divided by the low-angle tilt crystal grain boundaries was formed by the recovery of the crystal. Further, according to FIG. 2, it was observed that the first Al crystal grains, which were surrounded by the high-angle tilt crystal grain boundaries were large.

On the other hand, in FIG. 3 and FIG. 4, a large number of fine crystal grains, which were surrounded by the high-angle tilt crystal grain boundaries, were observed, rather than the inner part of the region surrounded by the high-angle tilt crystal grain boundaries as shown in FIG. 1 being separated by the low-angle tilt crystal grain boundaries. The fine crystal grains were recrystallized grains newly created by recrystallization during the aging treatment. That is, it was observed that the recrystallization occurred in the alloy wire rod of Comparative Example 2 compared to the alloy wire rod of Example 2.

It was considered that since the recrystallized grains had no internal strain, the tensile strength was greatly reduced in the alloy wire rod of Comparative Example 2 in which a large number of the recrystallized grains were observed. On the other hand, it was considered that, as in Example 2, in the alloy wire rod in which the recrystallized grains are small in number and the crystal structure resulting from recovery were formed, the processing strain was mitigated, but by having a moderate strain inside, the tensile strength was high as compared to comparative example 2.

Further, in Examples 1 to 12, it was observed that since fine recrystallized grains were less likely to be created during the aging treatment, the crystal grain diameters of the first Al crystal grains surrounded by the high-angle tilt crystal grain boundaries having a crystal orientation difference of 15 degrees or more were large compared to Comparative Examples 1 to 8. Specifically, in Examples 1 to 12, the crystal grain diameter was 12 μm to 19 μm, while in Comparative Examples 1 to 8, the crystal grain diameter was 6 μm to 9 μm. From this, it was observed that in Comparative Examples 1 to 8, there were a large number of fine recrystallized grains, and the crystal grain diameter was reduced accordingly. Note that the average grain diameter of the Al crystal grains, which were surrounded by the tilt crystal grain boundaries having a crystal orientation difference of 2 degrees or more were 3 μm to 7 μm in Examples 1 to 12, and 3 μm to 6 μm in Comparative Examples 1 to 8.

From the above, by adding Co or Ni and Zr to the aluminum melt as the alloy elements and producing the alloy wire rod from the cast rod produced by casting the melt by rapid cooling, it is possible to achieve the aluminum alloy wire rod, which has the strength, the elongation, the electrical conductivity, and the heat resistance at a high level and in a well-balanced manner.

<Preferred Aspects of the Present Invention>

Hereinafter, preferred aspects of the present invention will be supplementary described.

[Supplementary description 1] One aspect of the present invention is an aluminum alloy wire rod, comprising:

a wire rod made of an aluminum alloy, the aluminum alloy having a chemical composition consisting of:

Co: 0.1 to 1.0% by mass; Zr: 0.2 to 1.0% by mass; Fe: 0.02 to 0.15% by mass; Si: 0.02 to 0.15% by mass; Mg: 0 to 0.2% by mass; Ti: 0 to 0.10% by mass; B: 0 to 0.03% by mass; Cu: 0 to 1.00% by mass; Ag: 0 to 0.50% by mass; Au: 0 to 0.50% by mass; Mn: 0 to 1.00% by mass; Cr: 0 to 1.00% by mass; Hf: 0 to 0.50% by mass; V: 0 to 0.50% by mass; Sc: 0 to 0.50% by mass; and the balance: Al and inevitable impurities, the aluminum alloy having a metallographic structure including:

Al crystal grains; an Al—Zr compound; and an Al—Co—Fe compound, wherein, when a crystal orientation analysis of a cross section parallel to a longitudinal direction of the wire rod is performed by electron beam backscatter diffraction, the metallographic structure includes high-angle tilt crystal grain boundaries, each of which has a difference between crystal orientations in both its sides of 15 degrees or more, and low-angle tilt crystal grain boundaries, each of which has a difference between crystal orientations in both its sides of 2 degrees or more and less than 15 degrees, wherein an average grain diameter of ones of the Al crystal grains, which are surrounded by the high-angle tilt crystal grain boundaries, is 12 μm or more, while an average grain diameter of the ones of the Al crystal grains, which are surrounded by the high-angle tilt crystal grain boundaries, ones of the Al crystal grains, which are surrounded by the high-angle tilt crystal grain boundaries and the low-angle tilt crystal grain boundaries, and ones of the Al crystal grains, which are surrounded by the low-angle tilt crystal grain boundaries, is 10 μm or less.

[Supplementary Description 2]

In the aluminum alloy wire rod of Supplementary description 1, preferably, the Al—Co—Fe compound comprises a size of 20 nm or more and 1 μm or less.

[Supplementary Description 3]

In the aluminum alloy wire rod according to supplementary description 1 or 2, preferably, the Al—Zr compound comprises a size of 1 nm or more and 100 nm or less.

[Supplementary Description 4]

In the aluminum alloy wire rod according to any one of supplementary descriptions 1 to 3, preferably, its wire diameter is 2.0 mm or thinner.

[Supplementary Description 5]

In the aluminum alloy wire rod according to any one of supplementary descriptions 1 to 4, preferably, the Al—Co—Fe compound and the Al—Zr compound are of a spherical shape.

[Supplementary Description 6]

Another aspect of the present invention is a method for producing a wire rod made of an aluminum alloy, comprising:

preparing a molten metal having a chemical composition consisting of Co: 0.1 to 1.0% by mass, Zr: 0.2 to 1.0% by mass, Fe: 0.02 to 0.15% by mass, Si: 0.02 to 0.15% by mass, Mg: 0 to 0.2% by mass, Ti: 0 to 0.10% by mass, B: 0 to 0.03% by mass, Cu: 0 to 1.00% by mass, Ag: 0 to 0.50% by mass, Au: 0 to 0.50% by mass, Mn: 0 to 1.00% by mass, Cr: 0 to 1.00% by mass, Hf: 0 to 0.50% by mass, V: 0 to 0.50% by mass, Sc: 0 to 0.50% by mass, and the balance: Al and inevitable impurities;

casting the molten metal to form a cast rod;

subjecting the cast rod to a wire drawing to form a drawn wire rod; and subjecting the drawn wire rod to an aging treatment, wherein the casting is performed in such a manner as to adjust a temperature of the molten metal at not lower than 850 degrees C., pour the molten metal into a mold, and in that mold, cast the molten metal by rapid cooling at such a cooling rate as to allow the Co to crystallize out while suppressing the Zr from crystallizing out, to thereby form the cast rod including the Al—Co—Fe compound, wherein the aging treatment is performed in such a manner as to precipitate the Zr forming a solid solution in an Al phase of the drawn wire rod as an Al—Zr compound, wherein the aluminum alloy has a metallographic structure including the aforesaid chemical composition, Al crystal grains, the Al—Zr compound, and the Al—Co—Fe compound, wherein, when a crystal orientation analysis of a cross section parallel to a longitudinal direction of the wire rod is performed by electron beam backscatter diffraction, the metallographic structure includes high-angle tilt crystal grain boundaries, each of which has a difference between crystal orientations in both its sides of 15 degrees or more, and low-angle tilt crystal grain boundaries, each of which has a difference between crystal orientations in both its sides of 2 degrees or more and less than 15 degrees, wherein an average grain diameter of ones of the Al crystal grains, which are surrounded by the high-angle tilt crystal grain boundaries, is 12 μm or more, while an average grain diameter of the ones of the Al crystal grains, which are surrounded by the high-angle tilt crystal grain boundaries, ones of the Al crystal grains, which are surrounded by the high-angle tilt crystal grain boundaries and the low-angle tilt crystal grain boundaries, and ones of the Al crystal grains, which are surrounded by the low-angle tilt crystal grain boundaries, is 10 μm or less.

[Supplementary Description 7]

In the aluminum alloy wire rod producing method according to supplementary description 6, preferably, the casting is performed in such a manner as to drain out the molten metal from a holding bath with the molten metal being held therein and pour the molten metal into the mold, with the molten metal being maintained at a temperature of not lower than 850 degrees C. by heating until the molten metal drained out from the holding bath is poured into the mold.

[Supplementary Description 8]

In the aluminum alloy wire rod producing method according to supplementary description 6 or 7, preferably, the casting is performed in such a manner as to set the molten metal cooling rate at not lower than 20 degrees C./s and not higher than 200 degrees C./s.

[Supplementary Description 9]

In the aluminum alloy wire rod producing method according to any one of supplementary descriptions 6 to 8, preferably, the wire drawing is performed in such a manner as to draw the cast rod into a wire at such a degree of processing as to reduce the cast rod by 0.01 times or smaller in cross-sectional area.

[Supplementary Description 10]

In the aluminum alloy wire rod producing method according to any one of supplementary descriptions 6 to 9, preferably, the wire drawing is performed in such a manner as to reduce the drawn wire rod to 2.0 mm or thinner in wire diameter.

[Supplementary Description 11]

Another aspect of the present invention is an aluminum alloy wire rod, comprising:

a wire rod made of an aluminum alloy, the aluminum alloy having a chemical composition consisting of:

Ni: 0.1 to 1.0% by mass; Zr: 0.2 to 1.0% by mass; Fe: 0.02 to 0.15% by mass; Si: 0.02 to 0.15% by mass; Mg: 0 to 0.2% by mass; Ti: 0 to 0.10% by mass; B: 0 to 0.03% by mass; Cu: 0 to 1.00% by mass; Ag: 0 to 0.50% by mass; Au: 0 to 0.50% by mass; Mn: 0 to 1.00% by mass; Cr: 0 to 1.00% by mass; Hf: 0 to 0.50% by mass; V: 0 to 0.50% by mass; Sc: 0 to 0.50% by mass; and the balance: Al and inevitable impurities, the aluminum alloy having a metallographic structure including:

Al crystal grains; an Al—Zr compound; and an Al—Ni—Fe compound, wherein, when a crystal orientation analysis of a cross section parallel to a longitudinal direction of the wire rod is performed by electron beam backscatter diffraction, the metallographic structure includes high-angle tilt crystal grain boundaries, each of which has a difference between crystal orientations in both its sides of 15 degrees or more, and low-angle tilt crystal grain boundaries, each of which has a difference between crystal orientations in both its sides of 2 degrees or more and less than 15 degrees, wherein an average grain diameter of ones of the Al crystal grains, which are surrounded by the high-angle tilt crystal grain boundaries, is 12 μm or more, while an average grain diameter of the ones of the Al crystal grains, which are surrounded by the high-angle tilt crystal grain boundaries, ones of the Al crystal grains, which are surrounded by the high-angle tilt crystal grain boundaries and the low-angle tilt crystal grain boundaries, and ones of the Al crystal grains, which are surrounded by the low-angle tilt crystal grain boundaries, is 10 μm or less.

[Supplementary Description 12]

According to one aspect of the present invention, an aluminum alloy wire rod, comprising:

a wire rod made of an aluminum alloy, the aluminum alloy having a chemical composition consisting of:

Co: 0.1 to 1.0% by mass; Zr: 0.2 to 1.0% by mass; Fe: 0.02 to 0.15% by mass; Si: 0.02 to 0.15% by mass; Mg: 0 to 0.2% by mass; Ti: 0 to 0.10% by mass; B: 0 to 0.03% by mass; Cu: 0 to 1.00% by mass; Ag: 0 to 0.50% by mass; Au: 0 to 0.50% by mass; Mn: 0 to 1.00% by mass; Cr: 0 to 1.00% by mass; Hf: 0 to 0.50% by mass; V: 0 to 0.50% by mass; Sc: 0 to 0.50% by mass; and the balance: Al and inevitable impurities, the aluminum alloy having a metallographic structure including:

Al crystal grains; an Al—Zr compound; and an Al—Co—Fe compound, the aluminum alloy comprising:

a tensile strength of 180 MPa or higher;

an electrical conductivity of 53% IACS or higher; and an elongation of 10% or higher, whereby the aluminum alloy satisfies a condition for an Arrhenius plot, which is obtained from a temperature used and a time taken for the tensile strength of the wire rod to become 10% lower than its initial tensile strength, yielding 10 years or longer at a temperature of 200 degrees C.

[Supplementary Description 13]

In the aluminum alloy wire rod of supplementary description 12, preferably, the Al—Co—Fe compound comprises a size of 20 nm or more and 1 μm or less.

[Supplementary Description 14]

In the aluminum alloy wire rod of supplementary description 12 or 13, preferably, the Al—Zr compound is 1 nm or more and 100 nm or less.

[Supplementary Description 15]

In the aluminum alloy wire rod according to any one of supplementary descriptions 12 to 14, preferably, its wire diameter is 2.0 mm or thinner.

[Supplementary Description 16]

In the aluminum alloy wire rod of any one of supplementary descriptions 12 to 15, preferably, the Al—Co—Fe compound and the Al—Zr compound are of a spherical shape.

[Supplementary Description 17]

According to another aspect of the present invention, a method for producing a wire rod made of an aluminum alloy, comprising:

preparing a molten metal having a chemical composition consisting of Co: 0.1 to 1.0% by mass, Zr: 0.2 to 1.0% by mass, Fe: 0.02 to 0.15% by mass, Si: 0.02 to 0.15% by mass, Mg: 0 to 0.2% by mass, Ti: 0 to 0.10% by mass, B: 0 to 0.03% by mass, Cu: 0 to 1.00% by mass, Ag: 0 to 0.50% by mass, Au: 0 to 0.50% by mass, Mn: 0 to 1.00% by mass, Cr: 0 to 1.00% by mass, Hf: 0 to 0.50% by mass, V: 0 to 0.50% by mass, Sc: 0 to 0.50% by mass, and the balance: Al and inevitable impurities;

casting the molten metal to form a cast rod;

subjecting the cast rod to a wire drawing to form a drawn wire rod; and subjecting the drawn wire rod to an aging treatment, wherein the casting is performed in such a manner as to adjust a temperature of the molten metal at not lower than 850 degrees C., pour the molten metal into a mold, and in that mold, cast the molten metal by rapid cooling at such a cooling rate as to allow the Co to crystallize out while suppressing the Zr from crystallizing out, to thereby form the cast rod including the Al—Co—Fe compound, wherein the aging treatment is performed in such a manner as to precipitate the Zr forming a solid solution in an Al phase of the drawn wire rod as an Al—Zr compound, wherein the aluminum alloy has a metallographic structure including the aforesaid chemical composition, Al crystal grains, the Al—Co—Fe compound, and the Al—Zr compound, wherein the aluminum alloy comprises:

a tensile strength of 180 MPa or higher;

an electrical conductivity of 53% IACS or higher; and an elongation of 10% or higher, whereby the aluminum alloy satisfies a condition for an Arrhenius plot, which is obtained from a temperature used and a time taken for the tensile strength of the wire rod to become 10% lower than its initial tensile strength, yielding 10 years or longer at a temperature of 200 degrees C.

[Supplementary Description 18]

In the aluminum alloy wire rod producing method according to supplementary description 17, preferably, the casting is performed in such a manner as to drain out the molten metal from a holding bath with the molten metal being held therein and pour the molten metal into the mold, with the molten metal being maintained at a temperature of not lower than 850 degrees C. by heating until the molten metal drained out from the holding bath is poured into the mold.

[Supplementary Description 19]

In the aluminum alloy wire rod producing method according to supplementary description 17 or 18, preferably, the casting is performed in such a manner as to set the molten metal cooling rate at not lower than 20 degrees C./s and not higher than 200 degrees C./s.

[Supplementary Description 20]

In the aluminum alloy wire rod producing method according to any one of supplementary descriptions 17 to 19, preferably, the wire drawing is performed in such a manner as to draw the cast rod into a wire at such a degree of processing as to reduce the cast rod by 0.01 times or smaller in cross-sectional area.

[Supplementary Description 21]

In the aluminum alloy wire rod producing method according to any one of supplementary descriptions 17 to 20, preferably, the wire drawing is performed in such a manner as to reduce the drawn wire rod to 2.0 mm or thinner in wire diameter.

[Supplementary Description 22]

According to another aspect of the present invention, an aluminum alloy wire rod, comprising:

a wire rod made of an aluminum alloy, the aluminum alloy having a chemical composition consisting of:

Ni: 0.1 to 1.0% by mass; Zr: 0.2 to 1.0% by mass; Fe: 0.02 to 0.15% by mass; Si: 0.02 to 0.15% by mass; Mg: 0 to 0.2% by mass; Ti: 0 to 0.10% by mass; B: 0 to 0.03% by mass; Cu: 0 to 1.00% by mass; Ag: 0 to 0.50% by mass; Au: 0 to 0.50% by mass; Mn: 0 to 1.00% by mass; Cr: 0 to 1.00% by mass; Hf: 0 to 0.50% by mass; V: 0 to 0.50% by mass; Sc: 0 to 0.50% by mass; and the balance: Al and inevitable impurities, the aluminum alloy having a metallographic structure including:

Al crystal grains; an Al—Zr compound; and an Al—Ni—Fe compound, the aluminum alloy comprising:

a tensile strength of 180 MPa or higher;

an electrical conductivity of 53% IACS or higher; and an elongation of 10% or higher, whereby the aluminum alloy satisfies a condition for an Arrhenius plot, which is obtained from a temperature used and a time taken for the tensile strength of the wire rod to become 10% lower than its initial tensile strength, yielding 10 years or longer at a temperature of 200 degrees C.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An aluminum alloy wire rod, comprising:

a wire rod made of an aluminum alloy, the aluminum alloy having a chemical composition consisting of:

Co or Ni: 0.1 to 1.0% by mass; Zr: 0.2 to 1.0% by mass; Fe: 0.02 to 0.15% by mass; Si: 0.02 to 0.15% by mass; Mg: 0 to 0.2% by mass; Ti: 0 to 0.10% by mass; B: 0 to 0.03% by mass; Cu: 0 to 1.00% by mass; Ag: 0 to 0.50% by mass; Au: 0 to 0.50% by mass; Mn: 0 to 1.00% by mass; Cr: 0 to 1.00% by mass; Hf: 0 to 0.50% by mass; V: 0 to 0.50% by mass; Sc: 0 to 0.50% by mass; and the balance: Al and inevitable impurities, the aluminum alloy having a metallographic structure including:

Al crystal grains; an Al—Zr compound; and an Al—Co—Fe compound when containing the Co, or an Al—Ni—Fe compound when containing the Ni, wherein, when a crystal orientation analysis of a cross section parallel to a longitudinal direction of the wire rod is performed by electron beam backscatter diffraction, the metallographic structure includes high-angle tilt crystal grain boundaries, each of which has a difference between crystal orientations in both its sides of 15 degrees or more, and low-angle tilt crystal grain boundaries, each of which has a difference between crystal orientations in both its sides of 2 degrees or more and less than 15 degrees, wherein an average grain diameter of first Al crystal grains, which are surrounded by the high-angle tilt crystal grain boundaries, is 12 μm or more, while an average grain diameter of the first Al crystal grains, which are surrounded by the high-angle tilt crystal grain boundaries, Al crystal grains, which are surrounded by the high-angle tilt crystal grain boundaries and the low-angle tilt crystal grain boundaries, and second Al crystal grains, which are surrounded by the low-angle tilt crystal grain boundaries, is 10 μm or less.

2. The aluminum alloy wire rod according to claim 1, wherein the Al—Co—Fe compound or the Al—Ni—Fe compound comprises a size of 20 nm or more and 1 μm or less.

3. The aluminum alloy wire rod according to claim 1, wherein the Al—Zr compound comprises a size of 1 nm or more and 100 nm or less.

4. The aluminum alloy wire rod according to claim 1, further comprising a wire diameter of 2.0 mm or thinner.

5. The aluminum alloy wire rod according to claim 1, wherein the Al—Co—Fe compound or the Al—Ni—Fe compound and the Al—Zr compound are of a spherical shape.

6. A method for producing a wire rod made of an aluminum alloy, comprising:

preparing a molten metal having a chemical composition consisting of Co or Ni: 0.1 to 1.0% by mass, Zr: 0.2 to 1.0% by mass, Fe: 0.02 to 0.15% by mass, Si: 0.02 to 0.15% by mass, Mg: 0 to 0.2% by mass, Ti: 0 to 0.10% by mass, B: 0 to 0.03% by mass, Cu: 0 to 1.00% by mass, Ag: 0 to 0.50% by mass, Au: 0 to 0.50% by mass, Mn: 0 to 1.00% by mass, Cr: 0 to 1.00% by mass, Hf: 0 to 0.50% by mass, V: 0 to 0.50% by mass, Sc: 0 to 0.50% by mass, and the balance: Al and inevitable impurities;

casting the molten metal to form a cast rod;

subjecting the cast rod to a wire drawing to form a drawn wire rod; and subjecting the drawn wire rod to an aging treatment, wherein the casting is performed in such a manner as to adjust a temperature of the molten metal at not lower than 850 degrees C., pour the molten metal into a mold, and in that mold, cast the molten metal by rapid cooling at such a cooling rate as to allow the Co to crystallize out while suppressing the Zr from crystallizing out, to thereby form the cast rod including the Al—Co—Fe compound when containing the Co, or the Al—Ni—Fe compound when containing the Ni, wherein the aging treatment is performed in such a manner as to precipitate the Zr forming a solid solution in an Al phase of the drawn wire rod as an Al—Zr compound, wherein the aluminum alloy has a metallographic structure including the aforesaid chemical composition, Al crystal grains, the Al—Zr compound, and the Al—Co—Fe compound or the Al—Ni—Fe compound, wherein, when a crystal orientation analysis of a cross section parallel to a longitudinal direction of the wire rod is performed by electron beam backscatter diffraction, the metallographic structure includes high-angle tilt crystal grain boundaries, each of which has a difference between crystal orientations in both its sides of 15 degrees or more, and low-angle tilt crystal grain boundaries, each of which has a difference between crystal orientations in both its sides of 2 degrees or more and less than 15 degrees, wherein an average grain diameter of first Al crystal grains, which are surrounded by the high-angle tilt crystal grain boundaries, is 12 μm or more, while an average grain diameter of the first Al crystal grains, which are surrounded by the high-angle tilt crystal grain boundaries, ones of the Al crystal grains, which are surrounded by the high-angle tilt crystal grain boundaries and the low-angle tilt crystal grain boundaries, and second Al crystal grains, which are surrounded by the low-angle tilt crystal grain boundaries, is 10 μm or less.

7. The aluminum alloy wire rod producing method according to claim 6, wherein the casting is performed in such a manner as to drain out the molten metal from a holding bath with the molten metal being held therein and pour the molten metal into the mold, with the molten metal being maintained at a temperature of not lower than 850 degrees C. by heating until the molten metal drained out from the holding bath is poured into the mold.

8. The aluminum alloy wire rod producing method according to claim 6, wherein the casting is performed in such a manner as to set the molten metal cooling rate at not lower than 20 degrees C./s and not higher than 200 degrees C./s.

9. The aluminum alloy wire rod producing method according to claim 6, wherein the wire drawing is performed in such a manner as to draw the cast rod into a wire at such a degree of processing as to reduce the cast rod by 0.01 times or smaller in cross-sectional area.

10. The aluminum alloy wire rod producing method according to claim 6, wherein the wire drawing is performed in such a manner as to reduce the drawn wire rod to 2.0 mm or thinner in wire diameter.

11. An aluminum alloy wire rod, comprising:

a wire rod made of an aluminum alloy, the aluminum alloy having a chemical composition consisting of:

Co or Ni: 0.1 to 1.0% by mass; Zr: 0.2 to 1.0% by mass; Fe: 0.02 to 0.15% by mass; Si: 0.02 to 0.15% by mass; Mg: 0 to 0.2% by mass; Ti: 0 to 0.10% by mass; B: 0 to 0.03% by mass; Cu: 0 to 1.00% by mass; Ag: 0 to 0.50% by mass; Au: 0 to 0.50% by mass; Mn: 0 to 1.00% by mass; Cr: 0 to 1.00% by mass; Hf: 0 to 0.50% by mass; V: 0 to 0.50% by mass; Sc: 0 to 0.50% by mass; and the balance: Al and inevitable impurities, the aluminum alloy having a metallographic structure including:

Al crystal grains; an Al—Zr compound; and an Al—Co—Fe compound when containing the Co, or an Al—Ni—Fe compound when containing the Ni, the aluminum alloy comprising:

a tensile strength of 180 MPa or higher;

an electrical conductivity of 53% IACS or higher; and an elongation of 10% or higher, wherein a tensile strength of the aluminum alloy wire rod when heated to 200 degrees C. for 10 years is 90% of its initial tensile strength.

12. The aluminum alloy wire rod according to claim 11, wherein the Al—Co—Fe compound or the Al—Ni—Fe compound comprises a size of 20 nm or more and 1 μm or less.

13. The aluminum alloy wire rod according to claim 11, wherein the Al—Zr compound or Al—Ni—Fe compound is 1 nm or more and 100 nm or less.

14. The aluminum alloy wire rod according to claim 11, further comprising a wire diameter of 2.0 mm or thinner.

15. The aluminum alloy wire rod according to claim 11, wherein the Al—Co—Fe compound or the Al—Ni—Fe compound and the Al—Zr compound are of a spherical shape.

16. The aluminum alloy wire rod producing method according to claim 6, wherein the aluminum alloy comprises: a tensile strength of 180 MPa or higher; an electrical conductivity of 53% IACS or higher; and an elongation of 10% or higher, and wherein a tensile strength of the aluminum alloy wire rod when heated to 200 degrees C. for 10 years is 90% of its initial tensile strength.

* * * * *